US006011935A

United States Patent [19]

Matsuzaka et al.

[11] Patent Number: 6,011,935

[45] Date of Patent: Jan. 4, 2000

[54] IMAGE FORMATION SYSTEM ALSO SERVING AS MICR PRINTER

[75] Inventors: Satoshi Matsuzaka; Kazumasa Fujiwara; Masami Shiokawa; Hiroshi Hashino; Satoshi Kishino; Osamu Shimizu, all of Ebina, Japan

[73] Assignee: Fuji Xerox Co., Ltd., Tokyo, Japan

[21] Appl. No.: 08/976,591

[22] Filed: Nov. 24, 1997

[30] Foreign Application Priority Data

Nov. 29, 1996 [JP] Japan ..... 8-319764

[51] Int. Cl.[7] ..... G03G 15/00; G03G 15/01

[52] U.S. Cl. ..... 399/12; 399/51; 399/67; 399/81; 399/111

[58] Field of Search ..... 399/12, 38, 46, 399/51, 67, 69, 81, 110, 111, 138, 90; 347/138, 152, 115; 492/18, 53

[56] References Cited

U.S. PATENT DOCUMENTS

| | | | |
|---|---|---|---|
| 4,666,290 | 5/1987 | Yoshiura | 399/12 |
| 4,803,521 | 2/1989 | Honda | 399/12 |
| 4,994,853 | 2/1991 | Fukuchi et al. | 399/12 |
| 5,001,519 | 3/1991 | Saito | 399/69 |
| 5,200,285 | 4/1993 | Carrish | 347/115 X |
| 5,510,884 | 4/1996 | Bov, Jr. et al. | 399/90 X |
| 5,839,020 | 11/1998 | Rushing et al. | 399/46 X |

FOREIGN PATENT DOCUMENTS

| | | |
|---|---|---|
| 61-132969 | 6/1986 | Japan . |
| 61-282855 | 12/1986 | Japan . |
| 4-109260 | 4/1992 | Japan . |
| 4-358165 | 12/1992 | Japan . |
| 7-3623 | 1/1995 | Japan . |
| 8-95468 | 4/1996 | Japan . |

*Primary Examiner*—Sandra Brase
*Assistant Examiner*—Sophia S. Chen
*Attorney, Agent, or Firm*—Oliff & Berridge, PLC

[57] ABSTRACT

An image formation system also serving as an MICR printer including a cartridge mount space for detachably mounting a process cartridge having an image support, a developing roll and a collection vessel, an optical writer ROS for forming an electrostatic latent image on the surface of the image support by a light beam of a predetermined light quantity, and a parameter change system having parameter storage means Me for storing image formation process parameters used when the process cartridge mounted in the cartridge mount space is a normal cartridge and when the process cartridge is an MICR cartridge for forming a ferromagnetic toner image that can be magnetically read, the parameter change system for setting the image formation process parameters in response to the type of process cartridge mounted in the cartridge mount space.

13 Claims, 16 Drawing Sheets

IMAGE FORMATION SYSTEM ALSO SERVING AS MICR PRINTER

BACKGROUND OF THE INVENTION

This invention relates to an image formation system such as an electrophotographic image formation system or an electrophotographic printer for developing an electrostatic latent image on an image support in toner and in particular to an image formation system also serving as an MICR (magnetic ink character recognition) printer that can form images that can be read in MICR for forming a ferromagnetic toner image that can be magnetically read.

The image formation system of the invention can be used as a normal image formation system or an MICR printer.

In an MICR system which automatically reads a check on which symbols such as an issuance company name (for example, a bank name) are printed in ferromagnetic toner, automatically inputs the read contents into a computer, and displays the read contents on a display, an MICR font section printed on a check requires a proper quantity of magnetism, an accurate magnetic read symbol recognition capability, and durability to make an image hard to lose even in sliding friction with a magnetic head at the magnetism read time.

Thus, conventional checks have been prepared by offset print or with dot printers; in recent years, for example, MICR toner has been developed as proposed in the Unexamined Japanese Patent Application Publication Nos. Hei 4-358165 and Hei 7-3623 and electrophotographic check preparation is started.

To provide an MICR characteristic (magnetic read characteristic) and durability, the MICR toner uses special magnetic powder to stabilize the quantity of magnetism and contains a large amount of wax to stabilize the durability as compared with the normal toner used usually in an electrophotographic process. Thus, the image formation system using the MICR toner must be compatible with the electrophotographic process suitable for the MICR toner and therefore must become an MICR-dedicated printer.

The MICR printer is a check issuing machine and is used only in special fields of banks, etc., thus the distribution amount of the MICR printers on the market is extremely small and it is difficult to provide the MICR printer at a low price.

Hitherto, already existing printer parts have been used for most of the image formation system main unit and only special portions in the electrophotographic process suitable for the MICR toner have been changed for making the MICR printer fit for practical use at a low price.

However, the user requiring the MICR printer is also a user of a normal printer, of course; such a user needs to install both normal and MICR printers. Therefore, if the image formation system as the MICR printer can be provided at a reasonably low price, more than one image formation system becomes necessary and the required installation space and power consumption are increased accordingly; it is uneconomical.

Some users may use the MICR printer as a normal printer intact, but the distribution amount of the MICR printers on the market is extremely small as compared with that of normal printers as described above, thus the unit cost per print sheet becomes high.

Hitherto, an image formation system for forming toner images in different colors by changing a process cartridge having a black toner and a process cartridge having a color toner has been known as described in the Unexamined Japanese Patent Application Publication No. Hei 8-95468. However, an image formation system having both a normal image formation function using an electrophotographic process and a special MICR printer function is not yet known.

The inventors repeated experiments using process cartridges storing normal toner and those storing MICR toner in an image formation system comprising an image formation system main unit and a process cartridge mounted detachably in the image formation system main unit.

According to the experiments, the inventors have found the differences between the normal toner and MICR toner in the following three properties:

(1) Developing property (2) Cleaning property (3) Fixing property

The normal toner is easy to generate concentration, has an excellent cleaning property of unnecessary toner remaining on the surface of an image support 51, and requires a comparatively small heat quantity for providing stable fixing.

In contrast, the MICR toner is hard to generate concentration, has a poor cleaning property of unnecessary toner remaining on the surface of an image support 51, and requires a larger heat quantity for providing stable fixing than the normal toner.

The normal printer and the MICR printer also differ in required image quality. The normal printer, which covers all types of documents containing texts, drawings, illustrations, etc., requires high quality of solid black concentration, fine line reproductivity, halftone gradation, character section sharpness, etc.

On the other hand, the MICR printer needs quality of an image section made up of fine lines called MICR font. For appropriate magnetic signal strength of the MICR font section and accurate waveform recognition of magnetic signals proper to characters, fine line reproductivity and durability to make an image hard to lose even in sliding friction with a magnetic head at the magnetism read time are particularly required.

Therefore, the normal toner and the MICR toner differ in optimum parameters of image formation process.

If the (1) developing property difference and (2) cleaning property difference between the normal toner and the MICR toner can be absorbed in a process cartridge because a developing machine and a cleaner are placed in the process cartridge and if the (3) fixing property difference between the normal toner and the MICR toner can be absorbed in an image formation system main unit because a fuser is placed in the image formation system main unit, a normal cartridge and an MICR cartridge are provided as process cartridges and are simply replaced with each other, whereby an image formation system also serving as an MICR printer can be provided.

(Examination of Cleaning Property)

The inventors have found by experiment for the (2) cleaning property that if a urethane blade of high hardness that can clean the MICR toner harder to clean, the normal toner easy to clean can be cleaned. That is, the cleaning property difference between the normal toner and the MICR toner can be absorbed by using the cleaning blade for cleaning the MICR toner.

(Examination of Developing Property)

The developing property varies greatly in charge, exposure, and developing in image formation process; an infinite number of parameters exist such as potentials of charge bias, developing bias, etc., laser beam light quantity, image support surface material (photosensitive body) type, developing device configuration, developing roll material, form, magnetic pole density, and magnetic pole position, and the optimum values also change with combination.

Fundamentally, if a common combination and common optimum values of parameters to make the MICR toner and the normal toner compatible with each other are found, common process cartridge except for toner can be used, but the inventors cannot find them as a result of carrying out one experiment after another.

Then, assuming that parameters and optimum values can be changed only for replacement parts together with a toner storage vessel considering a price and common use, such as an image support, a charge roll, and a developing roll disposed in a process cartridge, the inventors repeated experiments. As a result, it has been found that an aluminum tube in the developing roll is formed on a surface with a molybdenum oxide film for a normal printer or an almite film for an MICR printer, whereby the MICR toner and the normal toner can be made compatible with each other.

The inventors have found that for use as an MICR printer, a change may be made to an appropriate laser beam light quantity conforming to the developing property of the cartridge to be used under the above-mentioned conditions.

(Examination of Fixing Property)

If the heat quantity given to toner is too large, an offset occurs; if the heat quantity given to toner is too small, a fixing failure occurs. Thus, usually a fuser of every image formation system has temperature measurement means and a heating source is controlled on and off according to one threshold value to keep the temperature constant. Since the heat quantity given to toner is the product of temperature and time, the optimum heat quantity difference between the normal toner and MICR toner at the fixing time can be adjusted according to the temperature or time. The inventors have found that if the same fixing time is applied to the normal toner and the MICR toner, it is necessary to raise the fixing temperature of the MICR toner because the MICR toner has a necessary fixing heat quantity larger than the normal toner.

SUMMARY OF THE INVENTION

The invention is based on the above-described experiments and the examination result and it is an object of the invention;

to provide an image formation system that can be used as an MICR printer by replacing a process cartridge in the image formation system comprising an image formation system main unit and a process cartridge mounted detachably in the image formation system main unit.

Next, the invention to accomplish the object will be discussed.

(First Aspect of the Invention)

To accomplish the object, according to a first aspect of the invention, there is provided an image formation system also serving as an MICR printer comprising:

an image support (51) formed on a surface with an electrostatic latent image;

a cartridge mount space (V) for detachably mounting a process cartridge (U2) having a developing machine (66–69 and 71) having a developing roll (69) placed adjoining the image support (51) and transporting a developer to a developing area adjoining the image support (51) for developing a toner image on the electrostatic latent image on the image support (51);

an optical writer (ROS) for forming an electrostatic latent image on the surface of the image support (51) by a light beam (L) of a predetermined light quantity;

a transfer device (34) for transferring a toner image formed on the surface of the image support (51) to a transfer medium;

a fuser (F) for fixing the toner image on the transfer medium at a predetermined fixing temperature; and a parameter change system (C+Me) having parameter storage means (Me) for storing image formation process parameters used when the process cartridge (U2) mounted in the cartridge mount space (V) is a normal cartridge and when the process cartridge (U2) is an MICR cartridge for forming a ferromagnetic toner image that can be magnetically read, the parameter change system (C+Me) for setting the image formation process parameters in response to the type of process cartridge mounted in the cartridge mount space (V).

(Operation of First Aspect of the Invention)

In the image formation system also serving as an MICR printer of the first aspect of the invention having the configuration, the process cartridge (U2) having the image support (51), the developing machine (66–69 and 71), and the toner collection vessel (54) is mounted in the cartridge mount space (V) detachably.

The optical writer (ROS) forms an electrostatic latent image on the surface of the image support (51) by a light beam (L) of a predetermined light quantity. The developing roll (69) of the developing machine (66–69 and 71) placed adjoining the image support (51) transports a developer to the developing area adjoining the image support (51) for developing a toner image on the electrostatic latent image on the image support (51). The collection vessel (54) collects remaining toner on the image support (51).

The transfer device (34) transfers a toner image formed on the surface of the image support (51) to a transfer medium. The fuser (F) fixes the toner image on the transfer medium at a predetermined fixing temperature.

The parameter storage means (Me) of the parameter change system (C+Me) stores image formation process parameters used when the process cartridge (U2) mounted in the cartridge mount space (V) is a normal cartridge and when the process cartridge (U2) is an MICR cartridge for forming a ferromagnetic toner image that can be magnetically read. The parameter change system (C+Me) sets the image formation process parameters in response to the type of process cartridge mounted in the cartridge mount space (V).

Therefore, the image formation system also serving as an MICR printer of the first aspect of the invention can form an image in response to the appropriate process parameters set to use the normal cartridge or MICR cartridge. Since the MICR printer can be made up of common parts to the normal image formation system, it can be provided at low costs.

(Second Aspect of the Invention)

According to a second aspect of the invention, there is provided an MICR printer process cartridge (U2) mounted detachably in a cartridge mount space (V) of an image formation system main unit (U1) of an image formation system also serving as an MICR printer having a cartridge discrimination unit (Sg), the MICR printer process cartridge (U2) comprising:

a developing machine (66–69 and 71) having a developing roll (69) placed adjoining the image support (51) and transporting a developer to a developing area adjoining the image support (51) for developing a toner image on the electrostatic latent image on the image support (51); and a detected member for cartridge discrimination (81) indicating that the process cartridge (U2) mounted in the cartridge mount space (V) is the MICR cartridge for forming a ferromagnetic toner image that can be magnetically read.

(Operation of Second Aspect of the Invention)

The MICR printer process cartridge (U2) of the second aspect of the invention having the configuration is mounted detachably in the cartridge mount space (V) of the image formation system main unit (U1) of the image formation system also serving as an MICR printer having the cartridge discrimination unit (Sg).

The process cartridge (U2) has the image support (51), the developing machine (66–69 and 71), and the toner collection vessel (54). An electrostatic latent image is formed on the surface of the image support (51) of the process cartridge (U2). The developing roll (69) of the developing machine (66–69 and 71) is placed adjoining the image support (51) and transports a developer to the developing area adjoining the image support (51) for developing a toner image on the electrostatic latent image on the image support (51). The collection vessel (54) collects remaining toner on the image support (51).

The process cartridge (U2) has the detected member for cartridge discrimination (81) indicating that the process cartridge (U2) mounted in the cartridge mount space (V) is the MICR cartridge for forming a ferromagnetic toner image that can be magnetically read.

Therefore, if the cartridge mounted in the image formation system main unit (U1) is the MICR cartridge, the image formation system also serving as an MICR printer can set the parameters appropriate for the MICR cartridge and execute image formation process.

Therefore, the MICR printer process cartridge (U2) of the second aspect of the invention is mounted detachably in the image formation system main unit (U1) of the image formation system also serving as an MICR printer, whereby the image formation system can be used as an MICR printer. Therefore, the MICR printer can be made of the image formation system main unit having common parts to the normal image formation system, it can be provided at low costs.

(First Form of First Aspect of the Invention)

An image formation system also serving as an MICR printer of a first form of the first aspect of the invention comprises in the first aspect of the invention:

the normal cartridge having a developing roll (69) formed with a molybdenum oxide film on a surface of an aluminum tube and the MICR cartridge having a developing roll (69) formed with an alumite film on a surface of an aluminum tube.

(Operation of First Form of First Aspect of the Invention)

The image formation system also serving as an MICR printer of the first form of the first aspect of the invention having the configuration uses the normal cartridge having the developing roll (69) formed with a molybdenum oxide film on a surface of an aluminum tube and the MICR cartridge having the developing roll (69) formed with an alumite film on a surface of an aluminum tube, whereby the common image formation system main unit (U1) can be used to provide practical image quality as a normal printer or an MICR printer.

A roll comprising an aluminum tube formed on a surface with electroless Ni plating, aluminum, a phenol resin film, a reduced chromic acid film, or the like can be used as the developing roll (69) of the normal cartridge.

(Second Form of First Aspect of the Invention)

An image formation system also serving as an MICR printer of a second form of the first aspect of the invention comprises in the first aspect of the invention:

if the process cartridge is the MICR cartridge, the parameter change system (C+Me) for changing the light quantity of the light beam (L) of the optical writer (ROS), one of the image formation process parameters, in comparison with the normal cartridge.

(Operation of Second Form of First Aspect of the Invention)

In the image formation system also serving as an MICR printer of the second form of the first aspect of the invention having the configuration, if the process cartridge is the MICR cartridge, the parameter change system (C+Me) changes the light quantity of the light beam (L) of the optical writer (ROS), one of the image formation process parameters, in comparison with the normal cartridge, whereby the common image formation system main unit (U1) can be used to write an electrostatic latent image in an appropriate light quantity for a normal printer or an MICR printer.

(Third Form of First Aspect of the Invention)

An image formation system also serving as an MICR printer of a third form of the first aspect of the invention comprises in the first aspect of the invention:

if the process cartridge (U2) is the MICR cartridge, the parameter change system (C+Me) for changing a fixing temperature of the fuser (F), one of the image formation process parameters, in comparison with the normal cartridge.

(Operation of Third Form of First Aspect of the Invention)

In the image formation system also serving as an MICR printer of the third form of the first aspect of the invention having the configuration, if the process cartridge (U2) is the MICR cartridge, the parameter change system (C+Me) changes a fixing temperature of the fuser (F), one of the image formation process parameters, in comparison with the normal cartridge, whereby the common image formation system main unit (U1) can be used to fix an image at an appropriate fixing temperature for a normal printer or an MICR printer.

(Fourth Form of First Aspect of the Invention)

An image formation system also serving as an MICR printer of a fourth form of the first aspect of the invention comprises in the first aspect of the invention or in any of the first to third forms of the first aspect of the invention:

a parameter change input key, the parameter change system (C+Me) for setting the image formation process parameters in response to whether or not the parameter change input key is input.

(Operation of Fourth Form of First Aspect of the Invention)

In the image formation system also serving as an MICR printer of the fourth form of the first aspect of the invention having the configuration, the parameter change system (C+Me) sets the image formation process parameters in response to whether or not the parameter change input key is input, whereby the common image formation system main unit (U1) can be used to set appropriate parameters for a normal printer or an MICR printer for forming images.

(Fifth Form of First Aspect of the Invention)

An image formation system also serving as an MICR printer of a fifth form of the first aspect of the invention comprises in the first aspect of the invention or in any of the first to third forms of the first aspect of the invention:

a cartridge discrimination unit (Sg) for determining whether the process cartridge (U2) mounted in the cartridge mount space (V) is a normal cartridge or an MICR cartridge for forming a ferromagnetic toner image that can be magnetically read, the parameter change system (C+Me) for setting the image formation process parameters in response to the type of process cartridge (U2) determined by the cartridge discrimination unit (Sg).

(Operation of Fifth Form of First Aspect of the Invention)

In the image formation system also serving as an MICR printer of the fifth form of the first aspect of the invention having the configuration, the cartridge discrimination unit (Sg) determines whether the process cartridge (U2) mounted in the cartridge mount space (V) is a normal cartridge or an MICR cartridge for forming a ferromagnetic toner image that can be magnetically read. The parameter change system (C+Me) sets the image formation process parameters in response to the type of process cartridge (U2) determined by the cartridge discrimination unit (Sg).

Thus, the common image formation system main unit (U1) can be used to automatically set appropriate process parameters for a normal printer or an MICR printer for forming images.

(Sixth Form of First Aspect of the Invention)

An image formation system also serving as an MICR printer of a sixth form of the first aspect of the invention comprises in the fifth form of the first aspect of the invention:

the cartridge discrimination unit being made of an optical sensor for detecting a reflected light quantity from the mounted process cartridge (U2).

(Operation of Sixth Form of First Aspect of the Invention)

In the image formation system also serving as an MICR printer of the sixth form of the first aspect of the invention having the configuration, the optical sensor of the cartridge discrimination unit detects a reflected light quantity from the mounted process cartridge (U2). Whether the process cartridge (U2) mounted in the cartridge mount space (V) is a normal cartridge or an MICR cartridge can be sensed based on the detected reflected light quantity.

(Seventh Form of First Aspect of the Invention)

An image formation system also serving as an MICR printer of a seventh form of the first aspect of the invention comprises in the fifth form of the first aspect of the invention:

the cartridge discrimination unit (Sg) being made of a magnetic sensor for detecting a magnetic force from the mounted process cartridge (U2).

(Operation of Seventh Form of First Aspect of the Invention)

In the image formation system also serving as an MICR printer of the seventh form of the first aspect of the invention having the configuration, the cartridge discrimination unit (Sg) made of a magnetic sensor detects a magnetic force from the mounted process cartridge (U2). Whether the process cartridge (U2) mounted in the cartridge mount space (V) is a normal cartridge or an MICR cartridge can be sensed based on whether or not a magnetic force is detected.

(Eighth Form of First Aspect of the Invention)

An image formation system also serving as an MICR printer of an eighth form of the first aspect of the invention comprises in the fifth form of the first aspect of the invention:

the cartridge discrimination unit having a cartridge contact terminal (103) coming in contact with either the mounted MICR cartridge or normal cartridge for outputting a different electric signal when the cartridge contact terminal (103) comes in contact with the either cartridge from an electric signal when the cartridge contact terminal does not come in contact with the either cartridge.

(Operation of Eighth Form of First Aspect of the Invention)

In the image formation system also serving as an MICR printer of the eighth form of the first aspect of the invention having the configuration, the cartridge discrimination unit having the cartridge contact terminal (103) coming in contact with either the mounted MICR cartridge or normal cartridge outputs a different electric signal when the cartridge contact terminal (103) comes in contact with the either cartridge from an electric signal when the cartridge contact terminal does not come in contact with the either cartridge.

(Ninth Form of First Aspect of the Invention)

An image formation system also serving as an MICR printer of a ninth form of the first aspect of the invention comprises in the fifth form of the first aspect of the invention:

a control panel having a cartridge discrimination input key, the cartridge discrimination unit being made of means for determining whether or not the cartridge discrimination input key is input.

(Operation of Ninth Form of First Aspect of the Invention)

In the image formation system also serving as an MICR printer of the ninth form of the first aspect of the invention having the configuration, the cartridge discrimination unit made of the means for determining whether or not the cartridge discrimination input key is input determines whether the process cartridge (U2) mounted in the image formation system main unit (U1) is a normal cartridge or an MICR cartridge by whether or not the cartridge discrimination input key on the control panel is input.

(First Form of Second Aspect of the Invention)

An MICR printer process cartridge (U2) of a first form of the second aspect of the invention comprises in the second aspect of the invention:

the detected member for cartridge discrimination (81) being made of a magnet.

(Operation of First Form of Second Aspect of the Invention)

The MICR printer process cartridge (U2) of the first form of the second aspect of the invention having the configuration has the detected member for cartridge discrimination (81) made of a magnet. Therefore, the magnetic sensor can be used to easily determine whether or not the process cartridge (U2) mounted detachably in the cartridge mount space (V) of the image formation system main unit (U1) of the image formation system also serving as an MICR printer is an MICR cartridge.

(Second Form of Second Aspect of the Invention)

An MICR printer process cartridge (U2) of a second form of the second aspect of the invention comprises in the second aspect of the invention:

the detected member for cartridge discrimination (95) being made of a conductive member coming in contact with a component of the cartridge discrimination unit of the image formation system main unit (U1) for changing a detected potential of the cartridge discrimination unit.

(Operation of First Form of Second Aspect of the Invention)

In the MICR printer process cartridge (U2) of the second form of the second aspect of the invention having the configuration, the detected member for cartridge discrimination (95) made of a conductive member comes in contact with a component of the cartridge discrimination unit of the image formation system main unit (U1) for changing a detected potential of the cartridge discrimination unit. Therefore, the cartridge discrimination unit can easily determine whether or not the process cartridge (U2) mounted detachably in the cartridge mount space (V) of the image formation system main unit (U1) of the image formation system also serving as an MICR printer is an MICR cartridge.

BRIEF DESCRIPTION OF THE DRAWINGS

In the accompanying drawings:

FIG. 8A is a time chart of the warm-up processing when a normal cartridge is mounted and FIG. 8B is a time chart of the warm-up processing when an MICR cartridge is mounted, wherein the heavy solid line indicates a fuser F target temperature and the dotted line indicates an actual temperature;

9A is a time chart of the warm-up processing when a normal cartridge is mounted, and FIG. 9B is a time chart of the warm-up processing when an MICR cartridge is mounted, wherein the heavy solid heavy line indicates the fuser F target temperature and the dotted line indicates the actual temperature;

FIG. 10A is a time chart of the warm-up processing when a normal cartridge is mounted, and FIG. 10B is a time chart of the warm-up processing when an MICR cartridge is mounted, wherein the heavy solid line indicates the fuser F target temperature and the dotted line indicates the actual temperature;

FIG. 11A is a time chart of the warm-up processing when a normal cartridge is mounted, and FIG. 11B is a time chart of the warm-up processing when an MICR cartridge is mounted, wherein the heavy solid line indicates the fuser F target temperature and the dotted line indicates the actual temperature;

DETAILED DESCRIPTION OF THE PREFERRED EMBODIMENTS

Figure 1:
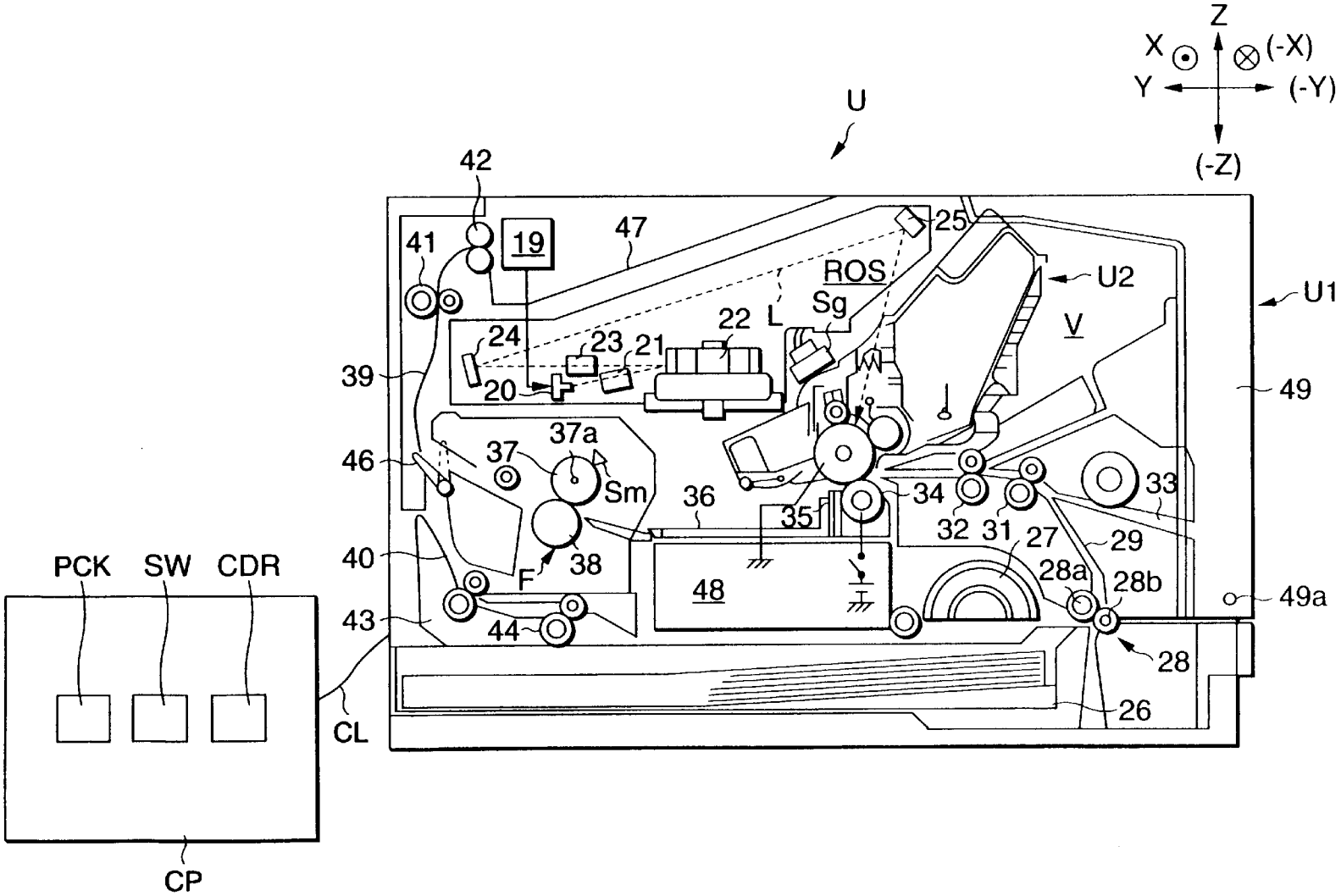
FIG. 1 is a general illustration of a first embodiment of an image formation system also serving as an MICR printer of the invention.

Referring now to the accompanying drawings, there are shown preferred embodiments of an image formation system of the invention. However, the invention is not limited to the following embodiments.

For easy understanding of the description to follow, rectangular coordinate axes X, Y, and Z are defined in the directions of arrows X, Y, and Z orthogonal to each other on the drawings and the arrow X direction is defined as the front, the arrow Y direction is defined as the left, and the arrow Z direction is defined as the top (upward). In this case, the opposite direction to the X direction (front), -X direction, becomes the rear, the opposite direction to the Y direction (left), -Y direction, becomes the right, and the opposite direction to the Z direction (top (upward)), -Z direction, becomes the bottom (downward).

The front (X direction) and the rear (-X direction) are collectively called the back and forth direction or the X axis direction, the left (Y direction) and the right (-Y direction) are collectively called the side to side direction or the Y direction, and the top (upward) (Z direction) and the bottom (downward) (-Z direction) are collectively called the up and down direction or the Z direction.

In the drawings, the symbol with • entered in 0 means an arrow directed from the rear of the paper face to the front and the symbol with X entered in 0 means an arrow directed from the front of the paper face to the rear.

(First Embodiment)

Figure 2:
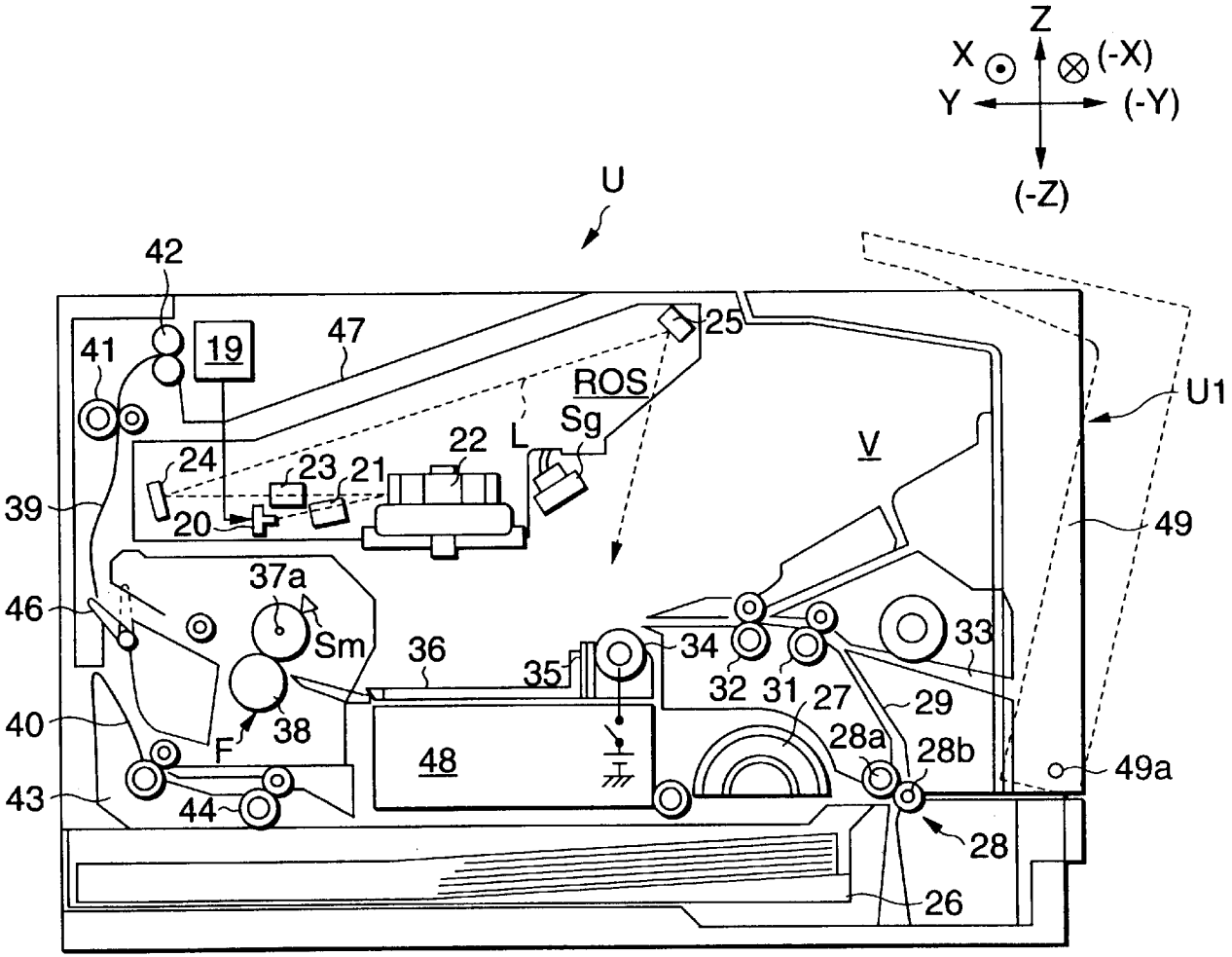
FIG. 2 is an illustration to show a main unit of the image formation system also serving as an MICR printer of the first embodiment of the invention.
Figure 3:
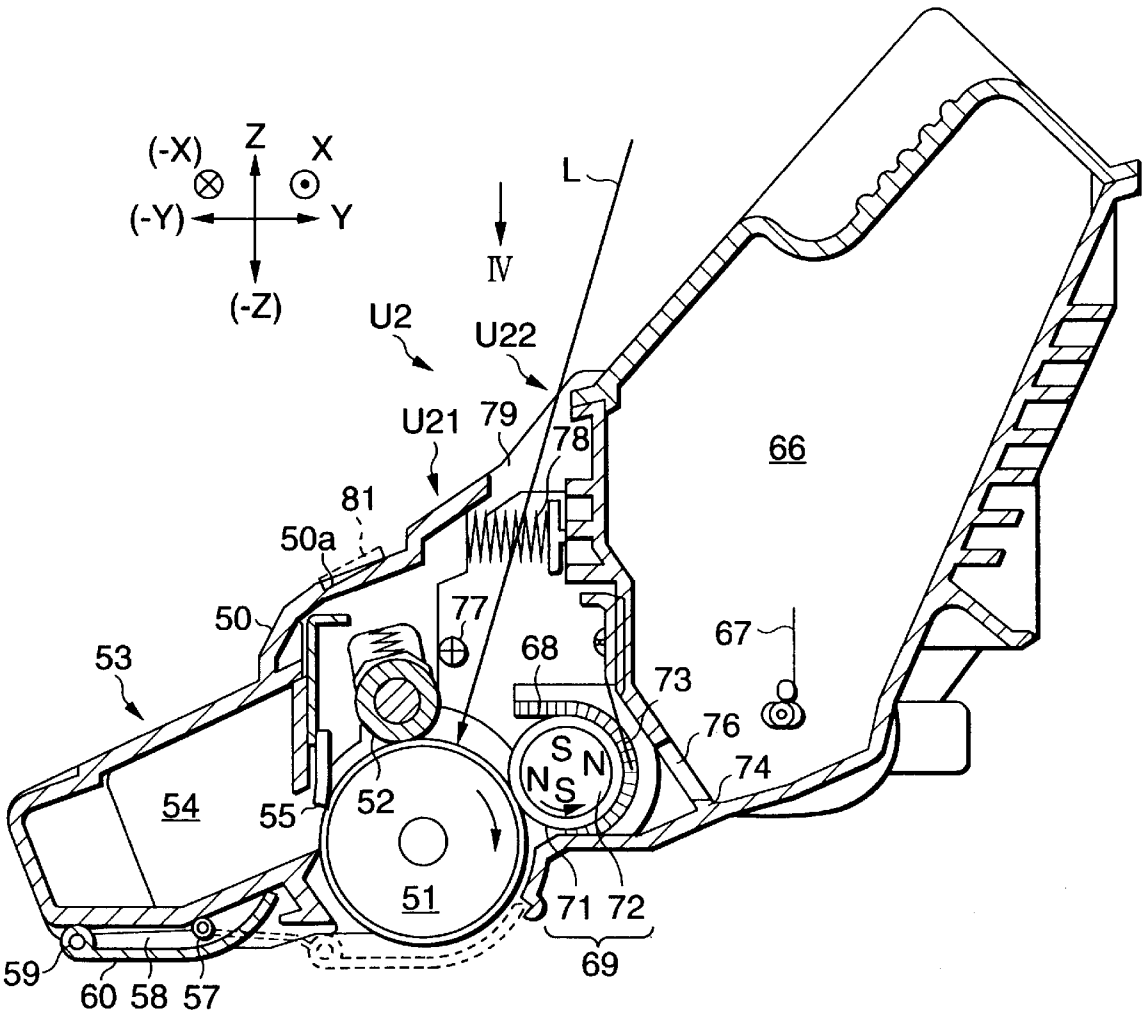
FIG. 3 is an illustration of a process cartridge mounted detachably in the main unit of the image formation system also serving as an MICR printer of the first embodiment of the invention.
Figure 4:
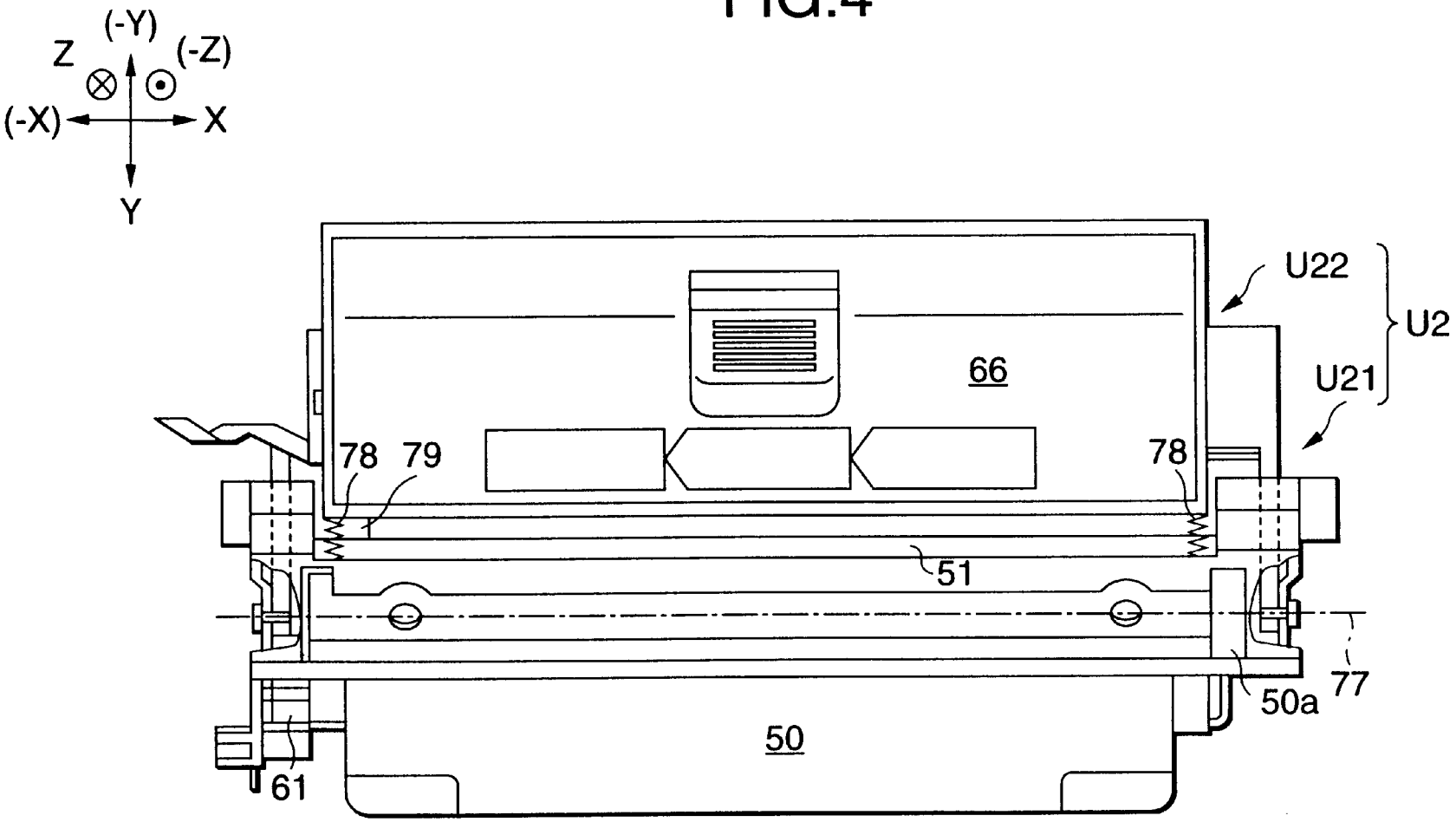
FIG. 4 is a view of the process cartridge from arrow IV in FIG. 3.

FIG. 1 is a general illustration of a first embodiment of an image formation system also serving as an MICR printer of the invention. FIG. 2 is an illustration to show a main unit of the image formation system also serving as an MICR printer of the first embodiment. FIG. 3 is an illustration of a process cartridge mounted detachably in the main unit of the image formation system also serving as an MICR printer of the first embodiment. FIG. 4 is a view of the process cartridge from arrow IV in FIG. 3.

In FIG. 1, an image formation system also serving as an MICR printer U of the first embodiment of the invention comprises an image formation system main unit (main unit of the image formation system also serving as an MICR printer) U1 and a process cartridge U2 mounted detachably in the image formation system main unit U1.

The image formation system main unit U1 has a laser drive signal output unit 19 which outputs a laser drive signal responsive to image data input from a host computer (not shown), etc., to an ROS (optical write scanner or a latent image formation unit).

The ROS is a unit for writing an electrostatic latent image on the surface of an image support of the process cartridge U2 described later. It has a laser diode 20 for emitting a laser beam L modulated by the laser drive signal, a convergent lens 21, a rotation polygon mirror 22, a fθ lens 23, mirrors 24 and 25, etc. A magnetic sensor Sg is placed below the ROS.

The image formation system main unit U1 has a paper feed tray 26 in the lower part. A semicircular paper taking-out roller 27 for taking out recording paper (copy paper) from the paper feed tray 26 is placed above the right (-Y side) of the paper feed tray 26. A handling roller device 28 is disposed at the right of the paper taking-out roller 27. It has a paper feed roller 28*a* and a retard roller 28*b* for transporting paper taken out from the paper taking-out roller 27 to a paper transport passage 29 one sheet at a time.

A transport roller 31 and a registration roller 32 are placed on the paper transport passage 29. A manual paper feed passage 33 is connected to the paper transport passage 29 upstream from the transport roller 31.

A transfer roll (transfer device) 34 is placed at the left of the registration roller 32. The transfer roll 34 is a member for transferring a toner image on the image support of the process cartridge U2 (described later) to paper; when paper is passed through the transfer roll 34, a positive voltage is applied.

A static elimination brush 35 for removing static electricity charged on paper passed through the transfer roll 34 is placed at the left of the transfer roll 34. A paper transport passage 36 for transporting paper to which a toner image is transferred to a fuser F is disposed at the left of the static elimination brush 35. The fuser F has a heating roll 37 and a pressurization roll 38 for heating and fixing an unfixed toner image on paper passed through the fuser F. The heating roll 37 contains a halogen heater 37*a*.

The surface temperature of the heating roll 37 is detected by means of a thermistor Sm.

A paper discharge passage 39 and a paper turning-over passage 40 are disposed at the left of the fuser F. A paper transport roller 41 and a paper discharge roller 42 are placed on the paper discharge passage 39. Paper transport rollers 43 and 44 are placed on the paper turning-over passage 40. A switch gate 46 for switching the paper transport direction is disposed at the connection part of the paper discharge passage 39 and the paper turning-over passage 40.

The switch gate 46 normally is held at a position (solid line position) for transporting paper discharged from the fuser F to the paper discharge passage 39. To perform one-side recording (make a one-side copy), paper having one side on which recording is performed is discharged from the discharge roller 42 of the paper discharge passage 39 to a paper discharge tray 47.

However, to perform double-side recording on paper, the switch gate 46 is switched to a phantom line position so that paper having one side on which recording is performed is once transported to the paper discharge passage 39 and then switched back into the paper turning-over passage 40.

The paper switched back into the paper turning-over passage 40 is stored in the paper feed tray 26 in turned-over relation. If the turned-over paper is taken out from the paper feed tray 26 and is transported to the transfer position (position of the transfer roll 34), a toner image is transferred to the opposite paper side to the first copy side. The paper having both sides on which images are thus recorded is discharged from the discharge roller 42 to the paper discharge tray 47.

A power supply 48 placed above the paper feed tray 26 is a power supply for supplying a drive current of a main motor Mm (see FIG. 5), a heating current of the heating roll 37, a transfer current of the transfer roll 34, etc.

A cartridge mount space V is formed above the power supply 48, the transfer roll 34, etc. A door 49 for opening and closing the cartridge mount space V is supported pivotably about a shaft 49*a* at the right of the cartridge mount space V.

The image formation system main unit U1 is made up of the members 19–29, 31–36, 38–44 and 46–49, A, Sg, etc. It is formed with the cartridge mount space V for inserting the process cartridge U2 above the paper taking-out roller 27, the transfer roller 34, etc. The process cartridge U2 is inserted and taken out from the upper right corner of the image formation system main unit U1.

(Configuration of Process Cartridge U2)

The following two types of process cartridges U2 are provided: Normal cartridge and MICR cartridge. They adopt a common configuration in most parts. Therefore, first the common configuration to the normal cartridge and MICR cartridge will be discussed, then the differences between the cartridges will be discussed.

(Common Configuration to Normal Cartridge and MICR Cartridge)

In FIGS. 3 and 4, the process cartridge U2 has an image support unit U21 and an image recording unit U22.

The image support unit U21 has a case 50 forming external walls, an image support 51 supported on the case 50, a charge roll 52 for uniformly charging the surface of the image support 51, and a cleaner 53 for collecting toner deposited on the surface of the image support 51. A magnet mount part 50*a* (see FIG. 4) is formed in the front of the top of the case 50 (X line part, see FIG. 4).

The image support 51 comprises a surface layer of an OPC (organic photosensitive body) formed on the surface of a cylindrical substrate made of aluminum. Since the OPC is negative charge, DC bias voltage piggybacked on AC voltage is applied to the charge roll 52. The voltage applied to the charge roll 52 is supplied from the power supply 48 of the image formation system main unit U1 when the process cartridge U2 is mounted in the image formation system main unit U1. Various conventional known configurations can be adopted as the configuration for supplying power from the image formation system main unit U1 to the process cartridge U2. The aluminum cylindrical substrate of the image support 51 is grounded.

The first embodiment is designed for exposing images to light; an image portion on the image support 51 (where toner is placed on recording paper) is exposed to laser beam L.

The cleaner 53 has a toner collection vessel 54 formed by the case 50 and a cleaning blade 55. The cleaning blade abuts the image support 51 at the tip. The first embodiment uses a high-hardness urethane blade as the cleaning blade 55. The remaining toner on the image support 51 is scrubbed away by the cleaning blade 55 and is stored in the toner collection vessel 54.

In FIG. 3, a plate spring 58 is supported at one end rotatably about a hinge shaft 57 below the toner collection vessel 54. A protective cover 60 is connected via a hinge shaft 59 to the other end of the plate spring 58.

The protective cover 60 can be moved between a closed position indicated by the phantom line in FIG. 3 and an open position indicated by the solid line when the plate spring 58 rotates about the hinge shaft 57. The protective cover 60 is held at the closed position indicated by the phantom line in FIG. 3 for covering the lower portion of the image support 51 before the process cartridge U2 is mounted in the image formation system main unit U1, and held at the open position indicated by the solid line after the process cartridge U2 is mounted.

The protective cover 60 is opened and closed by a cover handling member 61 (see FIG. 4) placed at the rear end of the image support unit U21.

The image support unit U21 is made up of the members 51–55 and 57–61.

The image recording unit U22 has a hopper 66 for storing mono component magnetic toner and an agitator (toner agitation member) supported rotatably on the hopper 66. A developing roll 69 is supported in a developing roll storage section 68 formed integrally on the outer face of the hopper 66.

The developing roll 69 is made up of a rotatable sleeve made of an aluminum pipe (namely, a developer support) 71 and a magnet roll 72 fixedly supported in the sleeve. The magnet roll 72 in the sleeve 71 has a developing pole N at a position facing the image support 51, a layer formation pole N existing in an upstream part adjoining a layer thickness regulation member 73 for regulating the layer thickness of a developer on the sleeve 71, and two transport poles S and S between the poles N for reliably attracting and holding toner on the sleeve 71.

When the process cartridge U2 is mounted in the image formation system main unit U1, negative DC bias voltage piggybacked on AC voltage is applied from the power supply 48 to the sleeve 71 of the developing roll 69. Since the aluminum cylindrical substrate of the image support 51 is grounded as described above, the negative DC bias voltage piggybacked on AC voltage is applied between the image support 51 and the sleeve 71. As the voltage is applied, toner negatively charged on the sleeve 71 is moved to the electrostatic latent image side on the image support 51 and the electrostatic latent image is developed as a toner image.

A developing machine is made up of the members 66–69, 71.

An opening 76 is made above a partition wall 74 provided between the hopper 66 and the developing roll storage section 68 at the bottom of the hopper 66. The upper end face of the partition wall 74 is set to a proper height so that toner can be easily moved from the hopper 66 through the opening 76 to the developing roll 69 (height lower than the height of an abutment part of the sleeve 71 and the layer thickness regulation member 73).

In FIGS. 3 and 4, the image support unit U21 and the image recording unit U22 are coupled relatively rotatably about an axis 77 at both ends in the back and forth direction (both ends at the X axis direction). The relatively rotatable image support unit U21 and image recording unit U22 receive a force of a compression spring 78 in the opening direction around the shaft 77. The developing roll 69 is pressed against the image support 51 by the force. The sleeve 71 of the developing roll 69 and the image support 51 abut each other in their axial outer end portions, namely, the outer portion of a developing area; the developing area between the sleeve 71 and the image support 51 (axial center area) is held with a proper spacing.

The image recording unit U22 of the process cartridge U2 is made up of the members 66–69 and 71–78.

An incident beam opening 79 for entering the laser beam L for writing a latent image onto the image support 51 is made between the image support unit U21 and the image recording unit U22.

(Differences Between Normal Cartridge and MICR Cartridge)

The following two types of process cartridges U2 are provided: Normal cartridge comprising normally used toner stored in the hopper 66 and MICR cartridge comprising MICR toner stored in the hopper 66. A permanent magnet (detected member for cartridge discrimination) 81 is mounted on the magnet mount part 50*a* of the MICR cartridge U2 (see FIGS. 3 and 4).

Therefore, when the MICR cartridge is mounted, the magnetic sensor Sg senses that the mounted process cartridge U2 is an MICR cartridge U2.

The magnetic sensor Sg can be attached to and detached from the image formation system main unit U1. The image formation system with no magnetic sensor Sg can be provided as a normal printer for the user who does not require the MICR printer function. In this case, the image formation system is shipped as a normal image formation system main unit (normal laser beam printer main unit) rather than the image formation system also serving as an MICR printer.

That is, the main unit of the image formation system also serving as an MICR printer can be made up of common parts to those of the normal image formation system main unit, so that the manufacturing costs of the image formation system that can be used as an MICR printer can be decreased.

As described above, both the normal cartridge and the MICR cartridge use mono component magnetic toner.

The MICR toner becomes magnetic toner because it needs to have capabilities of providing a proper magnetic force of a check and accurately recognizing magnetic read symbols by MICR (magnetic ink character recognition). A dual component toner, a magnetic mono component toner, or a nonmagnetic mono component toner can be used as the toner of the normal cartridge. However, considering common use of the process cartridge U2, the first embodiment uses the same magnetic mono component toner as the MICR toner.

Toner having residual magnetization of 4.0–7.0 emu/g and containing 2%–20% by weight of polyethylene 0.01–0.5 $\mu$m in disperse system is used as the MICR toner. Toner having residual magnetization of 2.0–4.0 emu/g and containing 1%–5% by weight of polyolefin is used as the normal toner.

In the first embodiment, the sleeve 71 of the developing roll 69 used with the normal cartridge is formed with a molybdenum oxide film 3 $\mu$m thick on the surface of the aluminum tube and the sleeve 71 of the developing roll 69 used with the MICR cartridge is formed with an alumite film 3.5 $\mu$m thick on the surface of the aluminum tube.

Figure 5:
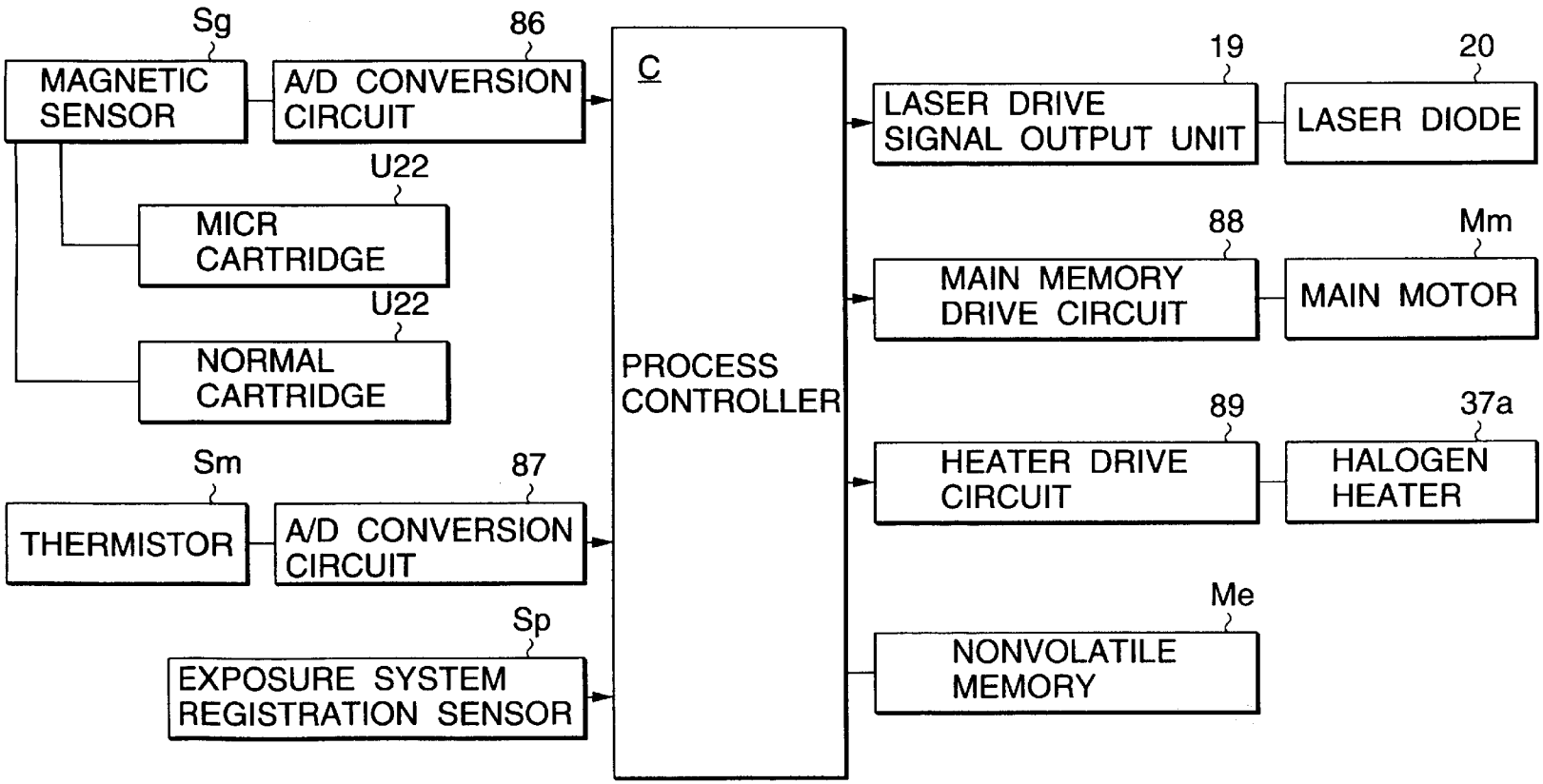
FIG. 5 is a block diagram to show the configuration of a control section of the first embodiment of the invention.

FIG. 5 is a block diagram to show the configuration of a control section of the first embodiment.

In FIG. 5, a process controller C is made of a computer.

The magnetic sensor (cartridge discrimination device) Sg senses whether the process cartridge U2 mounted in the cartridge mount space V is a normal cartridge or an MICR cartridge. That is, if the process cartridge U2 is an MICR cartridge, the permanent magnet 81 is mounted in the magnet mount part 50*a*, thus the magnetic sensor Sg outputs 5 V; if the process cartridge U2 is a normal cartridge, the magnetic sensor Sg outputs 0 V. When the detection signal of the magnetic sensor Sg is 0 V, an A/D conversion circuit 86 inputs "0" to the process controller C; when the detection signal is 5 V, the A/D conversion circuit 86 inputs "1" to the process controller C. The process controller C determines whether the process cartridge U2 mounted in the cartridge mount space V is a normal cartridge or an MICR cartridge in response to the input signal from the A/D conversion circuit 86. Alternatively, rather than a magnetic sensor, the cartridge discrimination unit Sg can be an optical sensor for detecting a reflected light quantity.

The thermistor Sm detects the temperature of the heating roll 37 and a detected temperature signal is input through an A/D conversion circuit 87 to the process controller C.

Detection signals from the exposure system registration sensor Sp and other sensors are adjusted in signal level and the resultant signals are input to the process controller C.

The process controller C outputs laser control signals such as image data and laser light amount control signals for turning on and off a laser beam to the laser drive signal output unit 19 (see FIG. 1). The laser drive signal output unit 19 drives the laser diode 20 in response to the input laser control signal.

The process controller C outputs a motor control signal to a main motor drive circuit 88, which then drives the main motor Mm in response to the input motor control signal.

The process controller C outputs a heater control signal to a heater drive circuit 89 in response to a detected temperature signal of the heating roll 37 from the thermistor Sm. The heater drive circuit 89 drives the halogen heater 37*a* in response to the input heater control signal.

A nonvolatile memory (parameter storage means) Me is connected to the process controller C.

Figure 6:
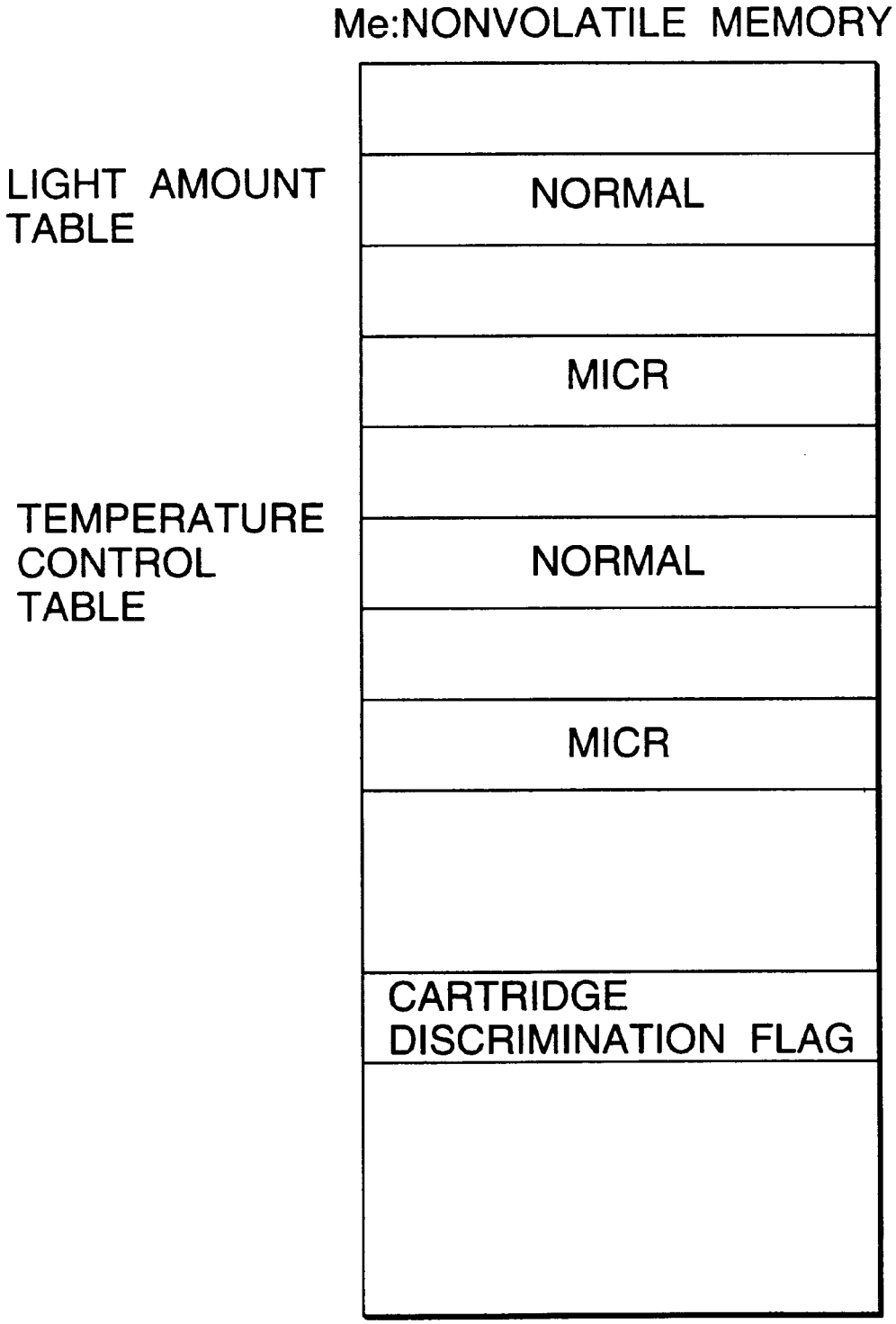
FIG. 6 is an illustration of data stored in a nonvolatile memory Me.

FIG. 6 is an illustration of data stored in the nonvolatile memory Me.

In FIG. 6, the nonvolatile memory Me stores a light amount table, a temperature control table, and a cartridge discrimination flag value.

The light amount table stores light amount data for emitting a different light amount of laser beam L depending on whether the process cartridge U2 mounted in the cartridge mount space V is a normal cartridge or an MICR cartridge. A value such that when the process cartridge U2 is an MICR cartridge, the light amount of the laser beam L becomes greater than that when the process cartridge U2 is a normal cartridge is stored as the light amount data.

The temperature control table stores temperature control data for fixing an image at a different fixing temperature depending on whether the process cartridge U2 mounted in the cartridge mount space V is a normal cartridge or an MICR cartridge. In the first embodiment, when the process cartridge U2 is a normal cartridge, the fixing temperature is set to 180° C.; when the process cartridge U2 is an MICR cartridge, the fixing temperature is set to 190° C.

When a normal cartridge is mounted, the cartridge discrimination flag is set to "0;" when an MICR cartridge is mounted, the cartridge discrimination flag is set to "1."

The process controller C and the nonvolatile memory (parameter storage means) Me make up a parameter change system (C+Me) for changing process parameters in response to whether the process cartridge U2 mounted in the cartridge mount space V is a normal cartridge or an MICR cartridge.

(Operation of First Embodiment)

Next, the operation of the first embodiment having the configuration described above will be discussed.

Figure 7:
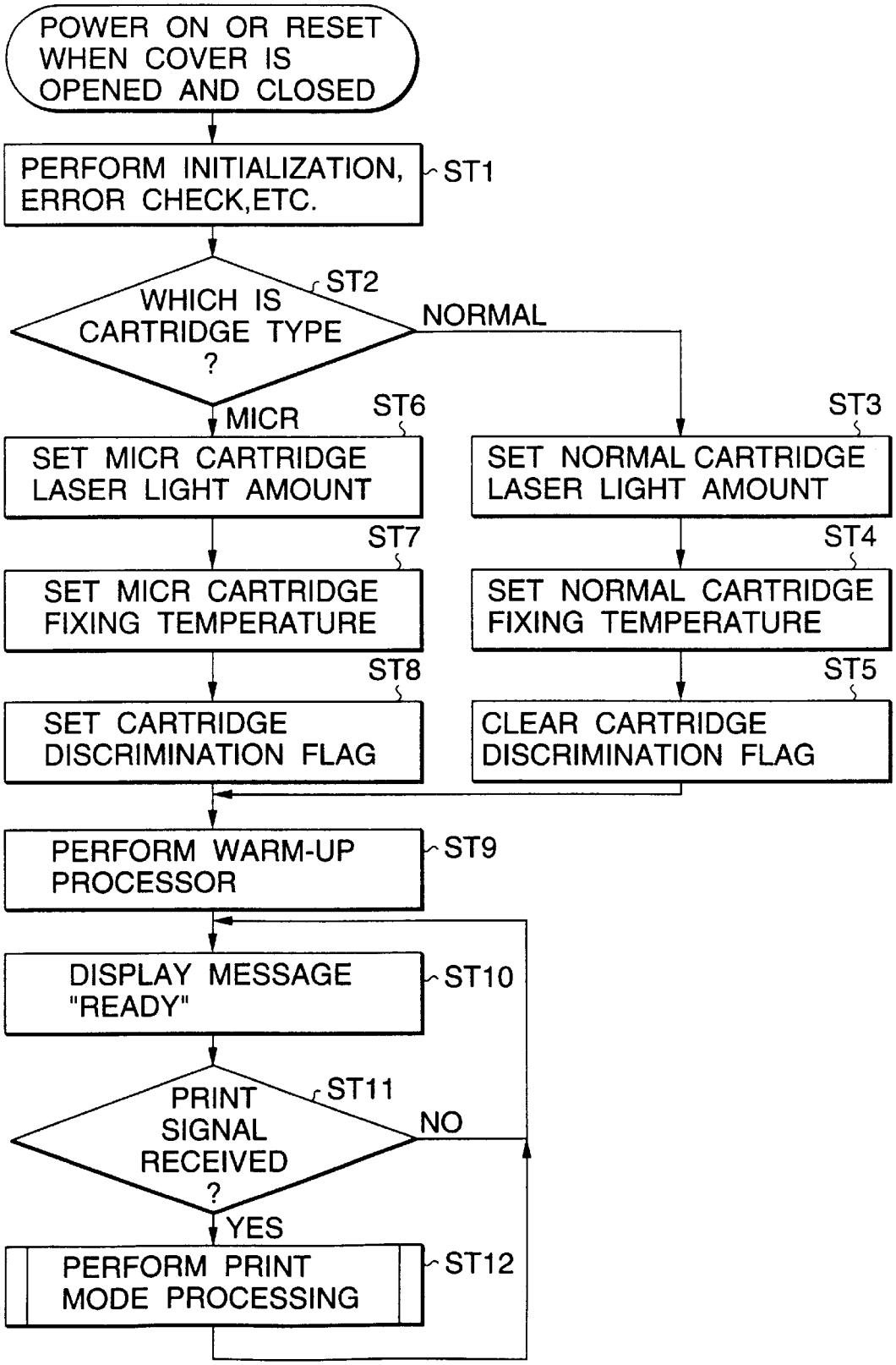
FIG. 7 is a flowchart of the operation of the first embodiment.

FIG. 7 is a flowchart of the operation of the first embodiment. This flowchart is executed by a program stored in the ROM of the process controller C made of a computer.

In FIG. 7, when the power is turned on or when the system is reset at the cover opening and closing time, processing not related to the invention (initialization, an error check, etc.,) is performed at step ST1.

Next, at step ST2, whether the process cartridge U2 mounted in the cartridge mount space V is a normal cartridge or an MICR cartridge is determined by the A/D conversion circuit 86 (see FIG. 5) based on whether the value input to the process controller C is "0" or "1" in response to the detection signal of the magnetic sensor Sg.

If the process cartridge U2 is determined a normal cartridge at step ST2, control goes to step ST3.

At step ST3, the normal cartridge laser light amount stored in the light amount table stored in the nonvolatile memory Me is set as a target value of the emitted light amount of the laser diode 20.

Next, at step ST4, the normal cartridge fixing temperature stored in the temperature control table stored in the nonvolatile memory Me is set as a target value of the fixing temperature.

Next, at step ST5, the cartridge discrimination flag is cleared to "0."

If the process cartridge U2 is determined an MICR cartridge at step ST2, control goes to step ST6.

At step ST6, the MICR cartridge laser light amount stored in the light amount table stored in the nonvolatile memory Me is set as a target value of the emitted light amount of the laser diode 20.

Next, at step ST7, the MICR cartridge fixing temperature stored in the temperature control table stored in the nonvolatile memory Me is set as a target value of the fixing temperature.

Next, at step ST8, the cartridge discrimination flag is set to "1."

Next, at step ST9, warm-up processing is performed for raising the temperature of the fuser F to the target value.

Figure 8A:
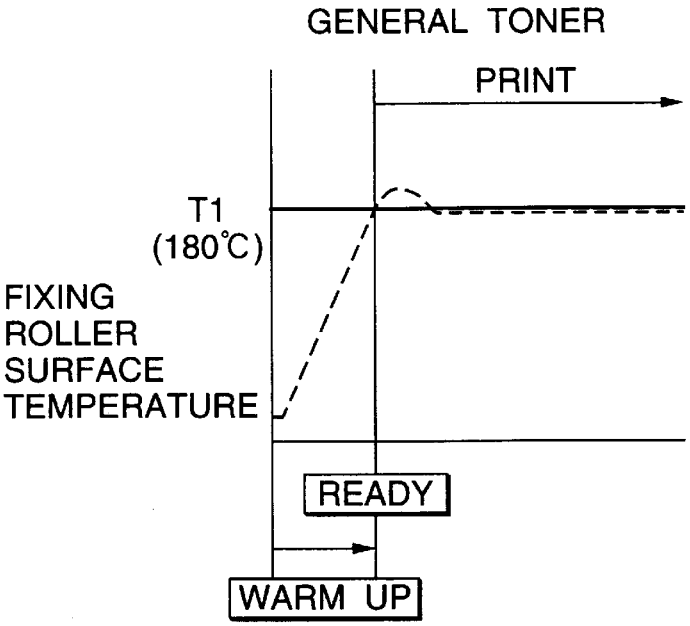
FIGS. 8A and 8B are time charts of warm-up processing of a fuser F.
Figure 8B:
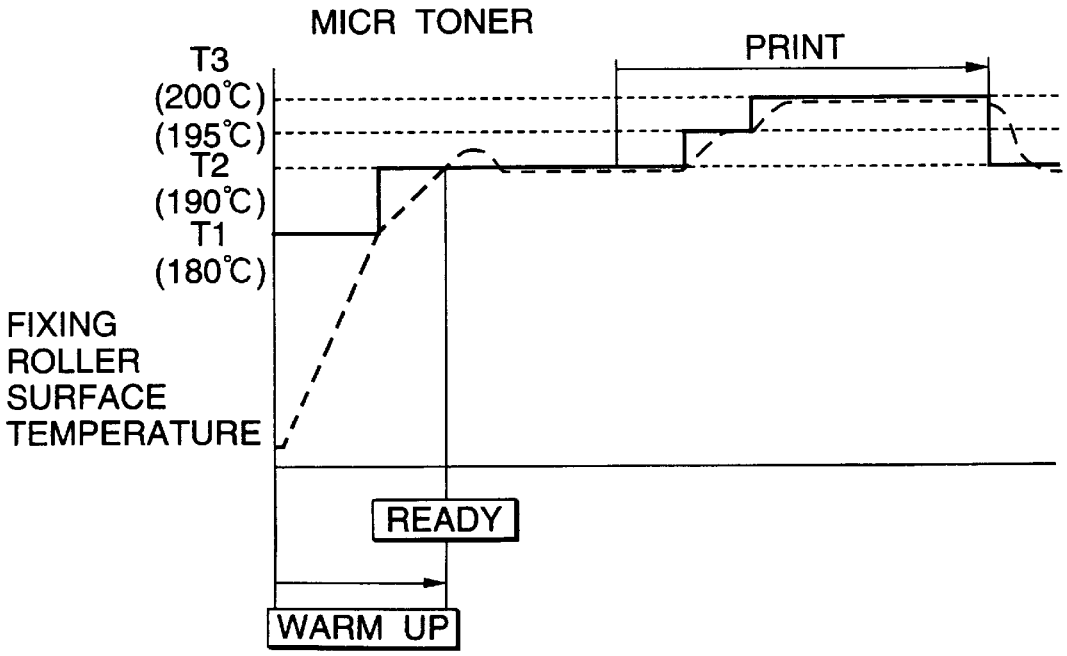

FIG. 8 is time charts of the warm-up processing of the fuser F; FIG. 8A is a time chart of the warm-up processing when a normal cartridge is mounted, and FIG. 8B is a time chart of the warm-up processing when an MICR cartridge is mounted, wherein the heavy solid line indicates the fuser F target temperature and the dotted line indicates the actual temperature.

The target value of the fuser F temperature (surface temperature of the fixing roll 37) is 180° C. when the process cartridge U2 is a normal cartridge, or 190° C. when the process cartridge U2 is an MICR cartridge.

In FIG. 8A, when the process cartridge U2 is a normal cartridge, the fuser F target temperature is set to 180° C. In this case, when the warm-up processing is started, the fixing temperature rises at a constant raising speed. The fixing temperature reaches 180° C. and overshoots the target temperature, then is held at 180° C. In the first embodiment, if the process cartridge U2 is a normal cartridge, when the fuser F temperature first reaches 180° C., a message "Ready" is displayed on the display section of the control panel, namely, the UI (user interface) at step ST10.

In FIG. 8B, when the process cartridge U2 is an MICR cartridge, the fuser F target temperature is first set to 180° C. In this case, when the warm-up processing is started, the fixing temperature rises at a constant raising speed. When it reaches 180° C., the target temperature is changed to 190° C. and the fixing temperature rises at a lower raising speed than the former speed. The fixing temperature reaches 190° C. and overshoots the target temperature, then is held at 190° C. In the first embodiment, if the process cartridge U2 is an MICR cartridge, when the fuser F temperature first reaches 190° C., a message "Ready" is displayed on the display section of the UI (user interface) at step ST10.

Next, at step ST11, whether or not a print signal is received from a connected computer is determined. If no print signal is received, control returns to step ST10. If a print signal is received, control goes to step ST12 at which print mode processing is performed, then control returns to step ST10.

As seen from the description of the flowchart in FIG. 7, the process control parameters are automatically set to proper values depending on whether the cartridge mounted in the cartridge mount space V is a normal cartridge or an MICR cartridge. Proper image recording is performed.

In FIG. 8B, the temperature of the fuser F after the warm-up processing is controlled so that it is held at 180° C. when a normal cartridge is mounted; the temperature is controlled so that it is held at 190° C. when an MICR cartridge is mounted. However, with the MICR cartridge, if the number of consecutive image recording sheets of paper becomes 10 or more, the target temperature is raised to 195°

C. to prevent the fuser temperature from lowering. If the number of consecutive image recording sheets of paper becomes 20 or more, the target temperature of the fuser F is raised to 200° C. for performing image recording on the twentieth or later sheet of paper for the following reason:

Since the MICR toner has a narrower heat quantity use range for toner to provide a stable fixing property than the normal toner (MICR toner 170° C.–210° C., normal toner 195° C.–210° C.), the target temperature is controlled step by step conforming to the number of recording sheets of paper, thereby decreasing overshoot occurring at the temperature raising time for providing stable fixing performance.

(Second Embodiment)

Figure 9A:
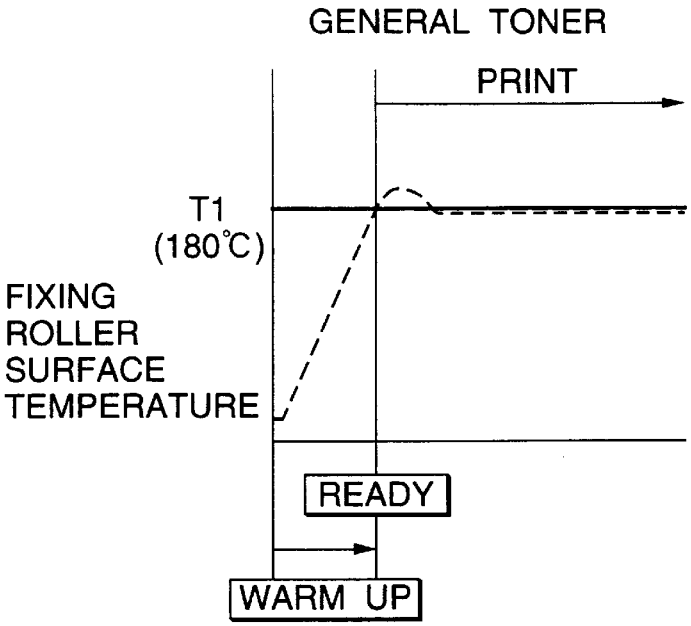
FIGS. 9A and 9B are time charts of warm-up processing of a fuser F of a second embodiment of an image formation system also serving as an MICR printer of the invention; FIG.
Figure 9B:
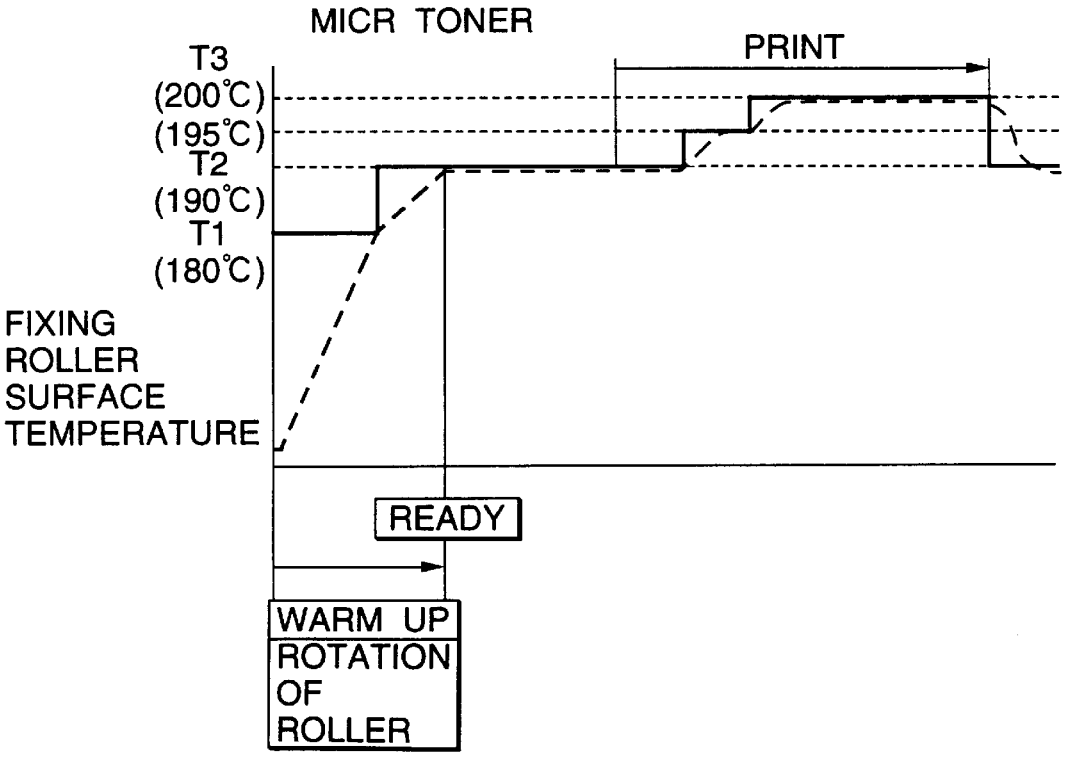

FIG. 9 is time charts of the warm-up processing of a fuser F of a second embodiment of an image formation system also serving as an MICR printer of the invention; FIG. 9A is a time chart of the warm-up processing when a normal cartridge is mounted and FIG. 9B is a time chart of the warm-up processing when an MICR cartridge is mounted, wherein the heavy solid line indicates the fuser F target temperature and the dotted line indicates the actual temperature.

The image formation system also serving as an MICR printer of the second embodiment is the same as that of the first embodiment except for temperature control method at the warming-up time of a fuser F when an MICR cartridge is used.

In the second embodiment, the fuser F is warmed up while a fixing roll 37 and a pressurization roll 38 of the fuser F are being rotated. In this case, the fixing roll 37 containing a halogen heater 37*a* is heated while transmitting heat to the pressurization roll 38, so that the temperature of the fuser F reaches the target temperature (190° C.) without large overshoot.

Since image recording may be performed in an overshoot state in the first embodiment, it is feared that uneven fixing may occur. In the second embodiment, however, image recording is not performed in an overshoot state, so that stable fixing can be executed.

(Third Embodiment)

Figure 10A:
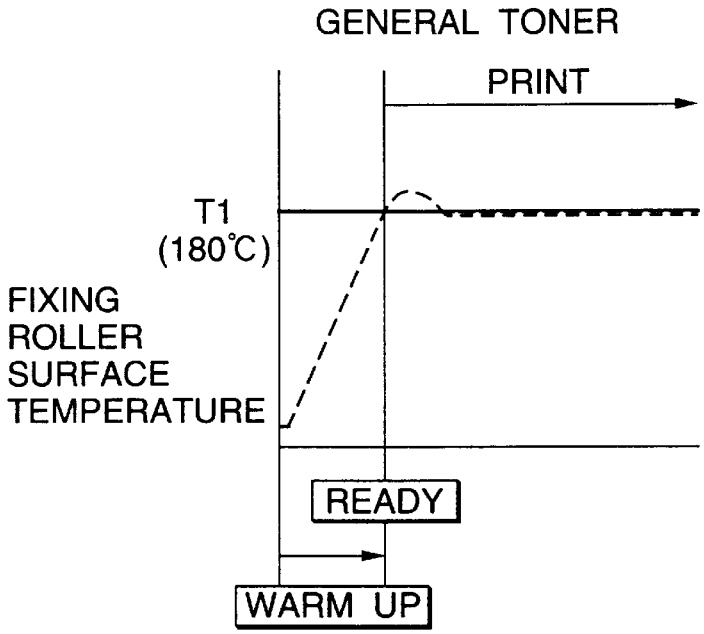
FIGS. 10A and 10B are time charts of warm-up processing of a fuser F of a third embodiment of an image formation system also serving as an MICR printer of the invention.
Figure 10B:
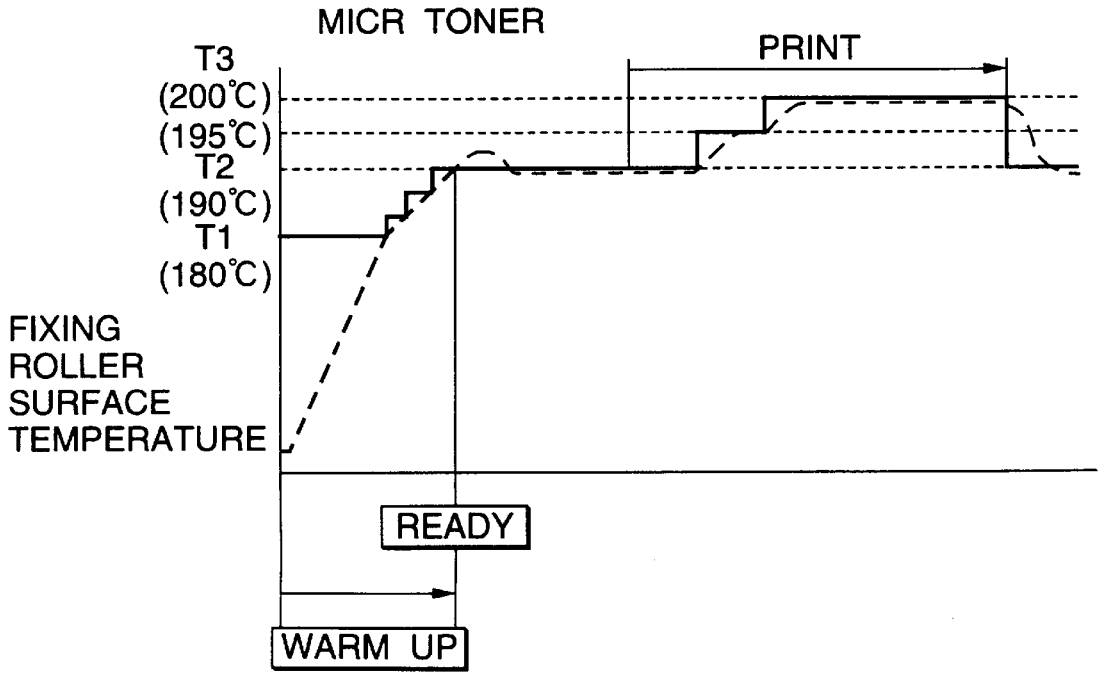

FIG. 10 is time charts of the warm-up processing of a fuser F of a third embodiment of an image formation system also serving as an MICR printer of the invention; FIG. 10A is a time chart of the warm-up processing when a normal cartridge is mounted, and FIG. 10B is a time chart of the warm-up processing when an MICR cartridge is mounted, wherein the heavy solid line indicates the fuser F target temperature and the dotted line indicates the actual temperature.

The image formation system also serving as an MICR printer of the third embodiment is the same as that of the first embodiment except for temperature control method at the warming-up time of a fuser F when an MICR cartridge is used.

In the third embodiment, when the fuser F is warmed up, the initial target temperature of the fuser F is set to 180° C. and after the target temperature (heavy solid line) reaches 180° C., it is inched up so that the temperature of the fuser F reaches the target temperature (190° C.) without large overshoot.

Also in the third embodiment, like the second embodiment, image recording is not performed in an overshoot state, so that stable fixing can be executed.

(Fourth Embodiment)

Figure 11A:
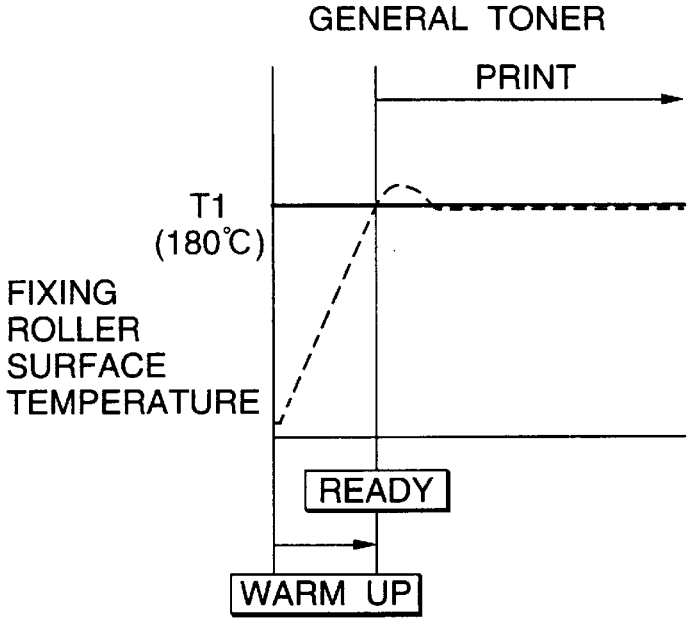
FIGS. 11A and 11B are time charts of warm-up processing of a fuser F of a fourth embodiment of an image formation system also serving as an MICR printer of the invention.
Figure 11B:
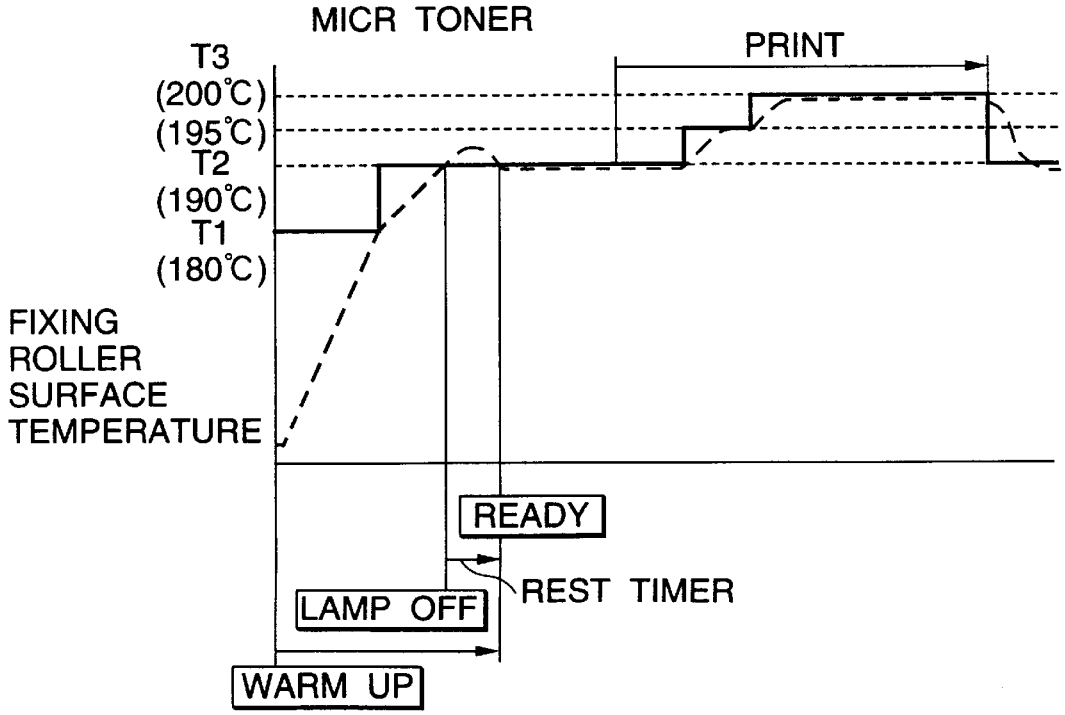

FIG. 11 is time charts of the warm-up processing of a fuser F of a fourth embodiment of an image formation system also serving as an MICR printer of the invention; FIG. 11A is a time chart of the warm-up processing when a normal cartridge is mounted and FIG. 11B is a time chart of the warm-up processing when an MICR cartridge is mounted, wherein the heavy solid line indicates the fuser F target temperature and the dotted line indicates the actual temperature.

The image formation system also serving as an MICR printer of the fourth embodiment is the same as that of the first embodiment except for temperature control method at the warming-up time of a fuser F when an MICR cartridge is used.

In the fourth embodiment, when the fuser F is warmed up, the initial target temperature of the fuser F is set to 180° C. and after the target temperature (heavy solid line) reaches 180° C., it is set to 190° C.; overshoot as in the first embodiment occurs. Then, in the fourth embodiment, message display of "Ready" is delayed by the time interval (rest time) t1 between the fixing temperature of the fuser F first reaching the target value 190° C. and then reaching the target value 190° C. after the expiration of overshoot.

Also in the fourth embodiment, like the second and third embodiments, image recording is not performed in an overshoot state, so that stable fixing can be executed.

(Fifth Embodiment)

Figure 12:
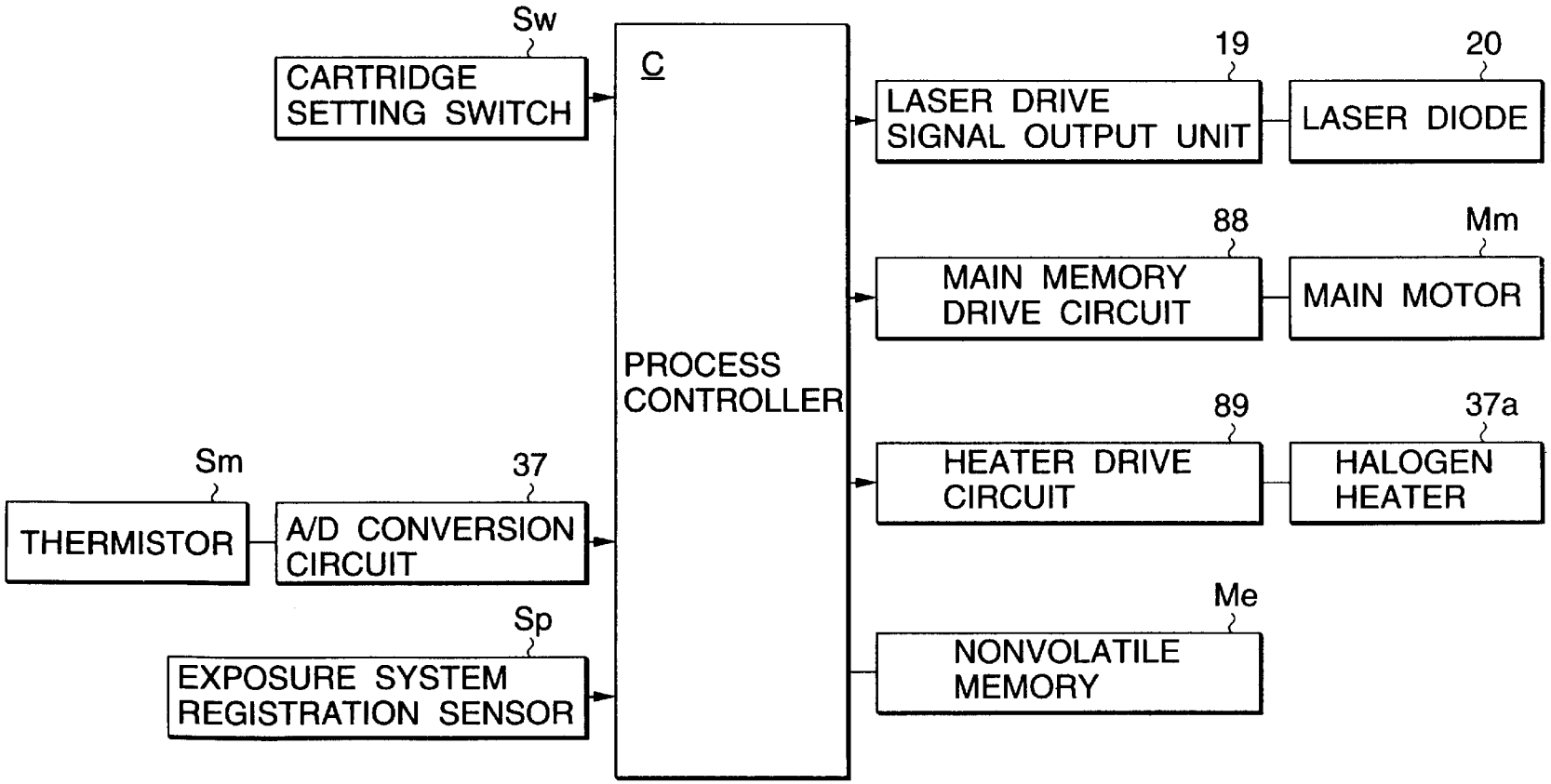
FIG. 12 is a block diagram to show the configuration of a control section of a fifth embodiment of an image formation system also serving as an MICR printer of the invention, corresponding to FIG. 5 in the first embodiment.
Figure 13:
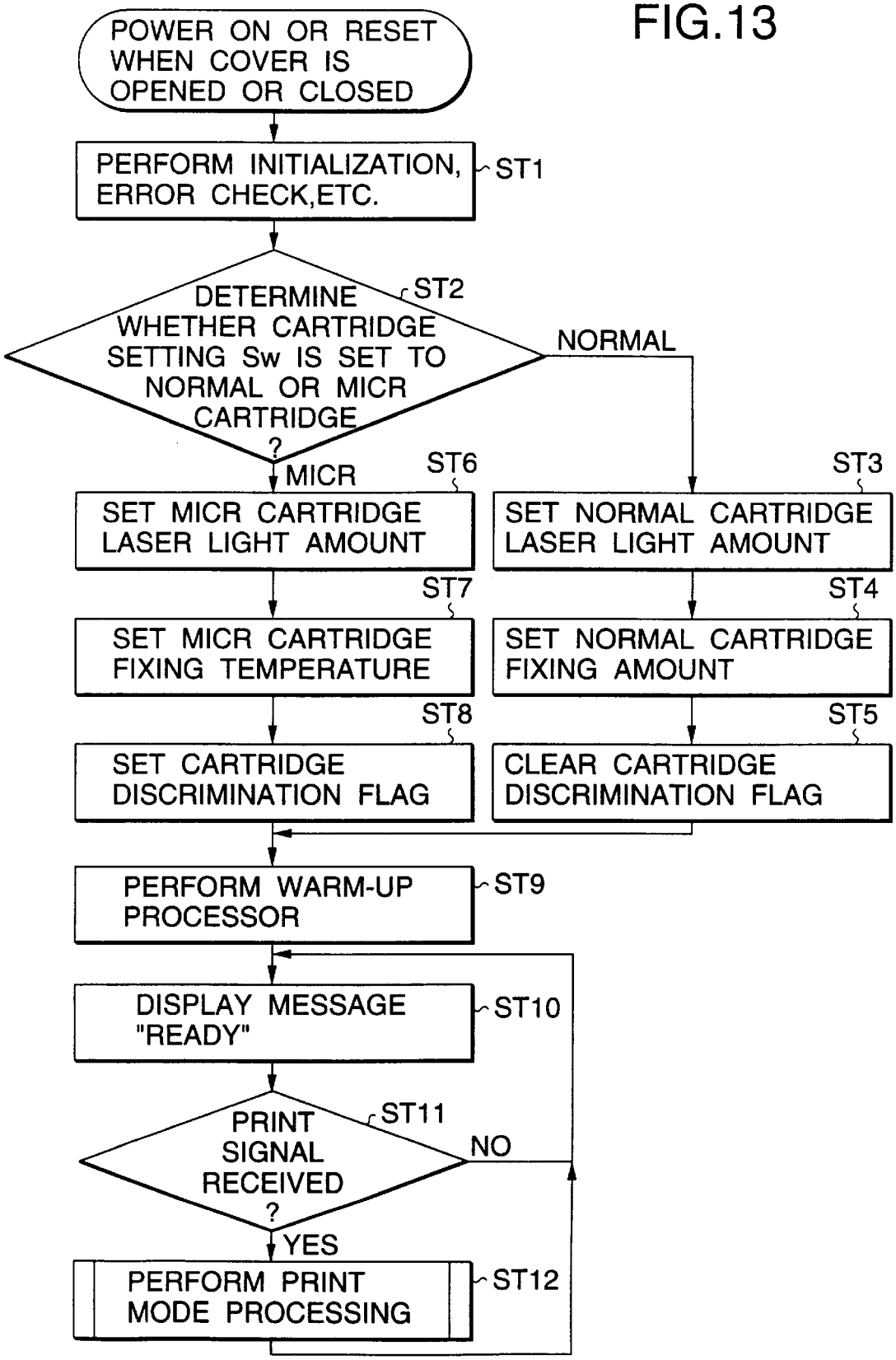
FIG. 13 is a flowchart of the fifth embodiment, corresponding to FIG. 7 in the first embodiment.

FIG. 12 is a block diagram to show the configuration of a control section of a fifth embodiment of an image formation system also serving as an MICR printer of the invention, corresponding to FIG. 5 in the first embodiment. FIG. 13 is a flowchart of the fifth embodiment, corresponding to FIG. 7 in the first embodiment.

The image formation system also serving as an MICR printer of the fifth embodiment is the same as that of the first embodiment except for means for sensing whether a process cartridge U2 mounted in cartridge mount space V of image formation system main unit U1 is a normal cartridge or an MICR cartridge. That is, the magnetic sensor Sg is used in the first embodiment; a cartridge setting switch SW operated by the user is used in the fifth embodiment. The cartridge setting switch SW can be placed at any position on the outer face of the image formation system main unit U1. Shown in FIG. 1, a control panel, represented by a black box CP, contains the switch SW, parameter change input key PCK and the cartridge discrimination key CDK. The control panel CP is shown connected to the unit by a connection line CL.

A process controller C operates assuming that a normal cartridge is mounted when the cartridge setting switch SW is set to OFF. The process controller C operates assuming that an MICR cartridge is mounted when the cartridge setting switch SW is set to ON.

As shown at step ST2 of the flowchart in FIG. 13, whether the mounted process cartridge U2 is a normal cartridge or an MICR cartridge is determined by whether the cartridge setting switch SW is ON or OFF.

(Sixth Embodiment)

Figure 14:
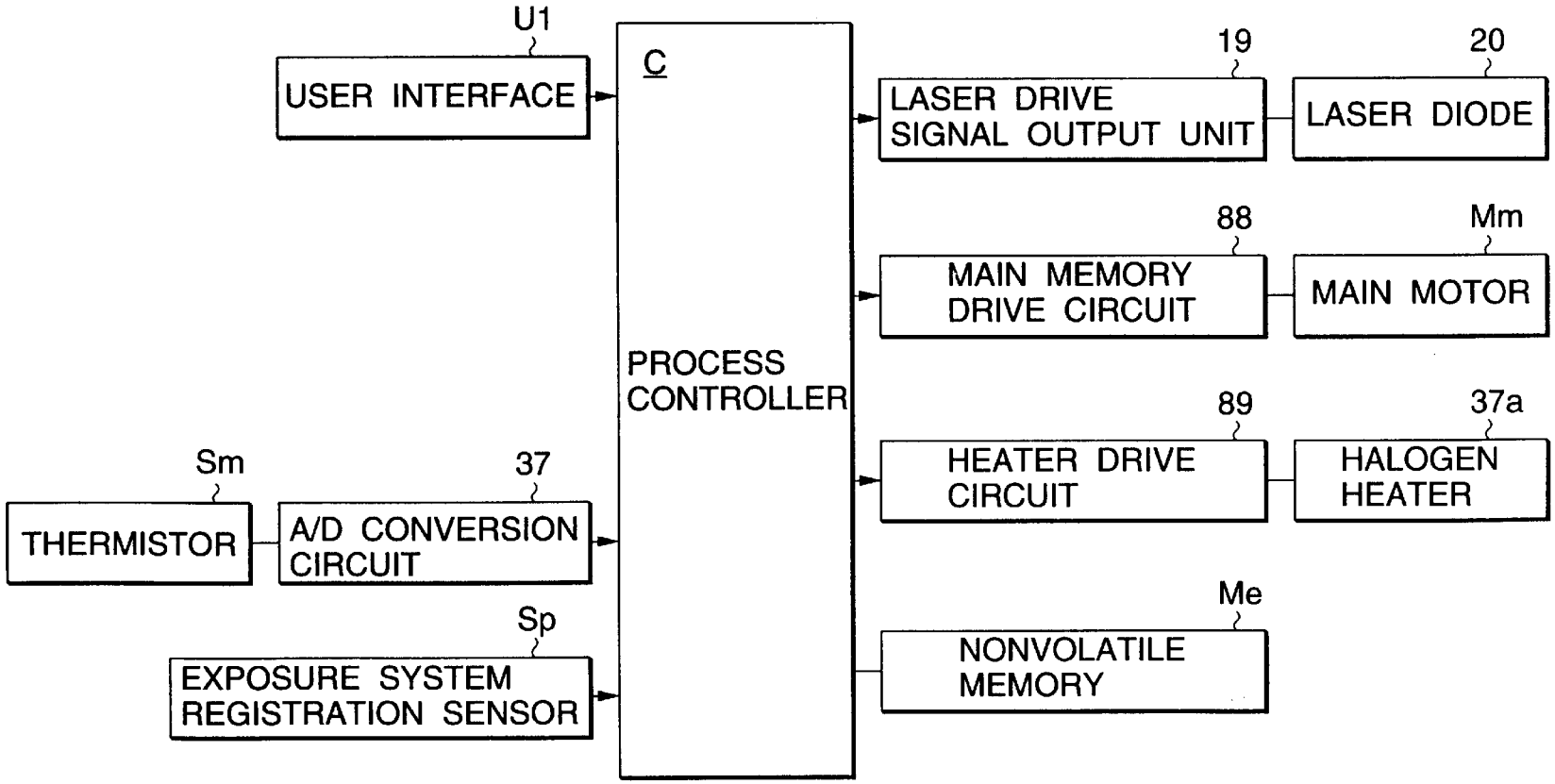
FIG. 14 is a block diagram to show the configuration of a control section of a sixth embodiment of an image formation system also serving as an MICR printer of the invention, corresponding to FIG. 5 in the first embodiment.
Figure 15:
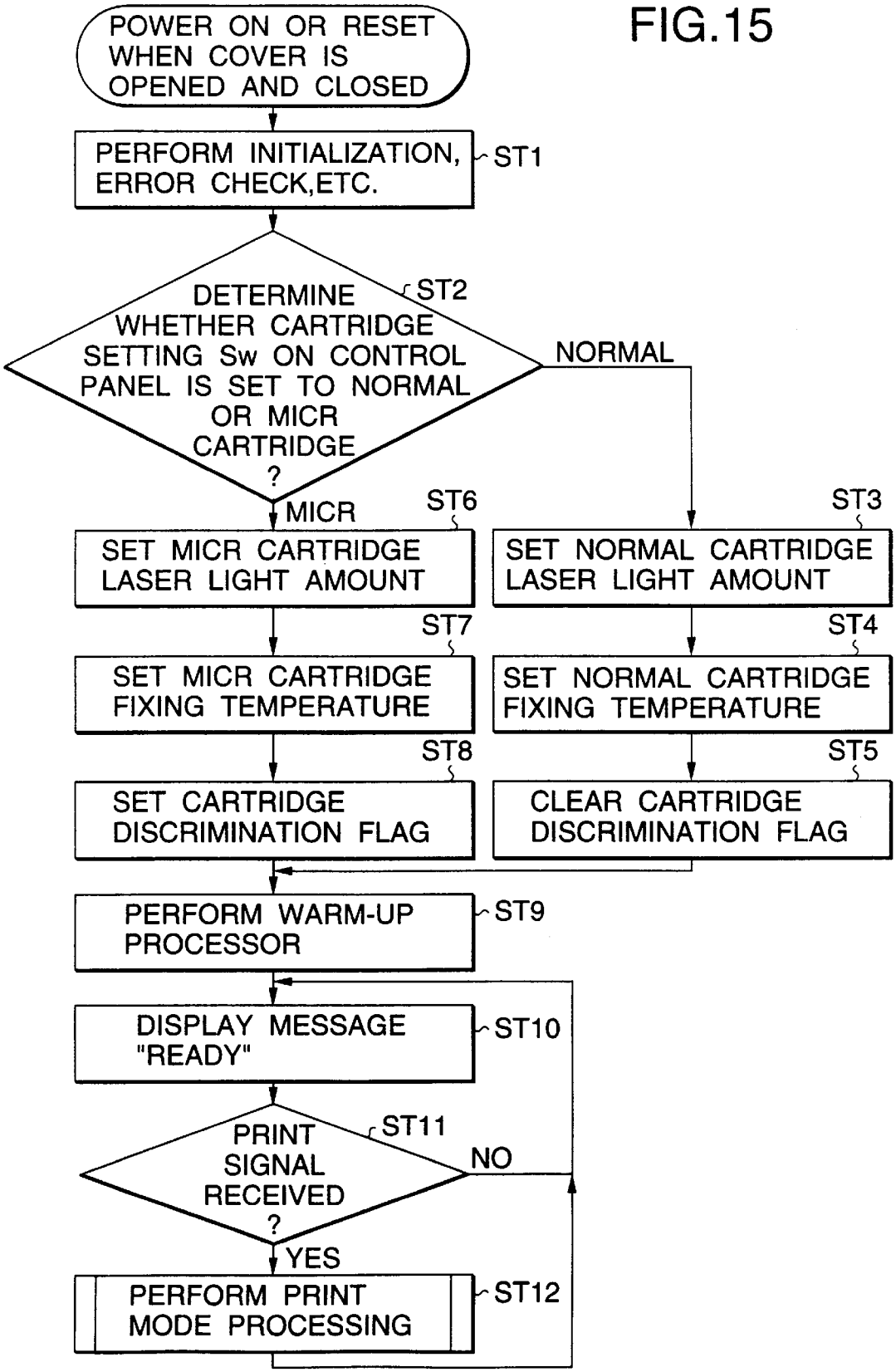
FIG. 15 is a flowchart of the sixth embodiment, corresponding to FIG. 7 in the first embodiment.

FIG. 14 is a block diagram to show the configuration of a control section of a sixth embodiment of an image formation system also serving as an MICR printer of the invention, corresponding to FIG. 5 in the first embodiment. FIG. 15 is a flowchart of the sixth embodiment, corresponding to FIG. 7 in the first embodiment.

The image formation system also serving as an MICR printer of the sixth embodiment is the same as that of the first embodiment except for means for sensing whether a process cartridge U2 mounted in cartridge mount space V of image formation system main unit U1 is a normal cartridge or an MICR cartridge. That is, the magnetic sensor Sg is used in the first embodiment; in the sixth embodiment, which of a normal cartridge and an MICR cartridge is mounted in the cartridge mount space V is determined by the setup state of a cartridge setting switch placed on a UI (user interface).

As shown at step ST2 of the flowchart in FIG. 15, whether the mounted process cartridge U2 is a normal cartridge or an MICR cartridge is determined by the state of the cartridge setting switch placed on a control panel, namely, the UI (user interface).

For the cartridge setting switch on the UI, a normal cartridge or an MICR cartridge can be set by turning on or off one switch as in the fifth embodiment; a normal cartridge setting switch and an MICR cartridge setting switch can be provided.

(Seventh Embodiment)

Figure 16:
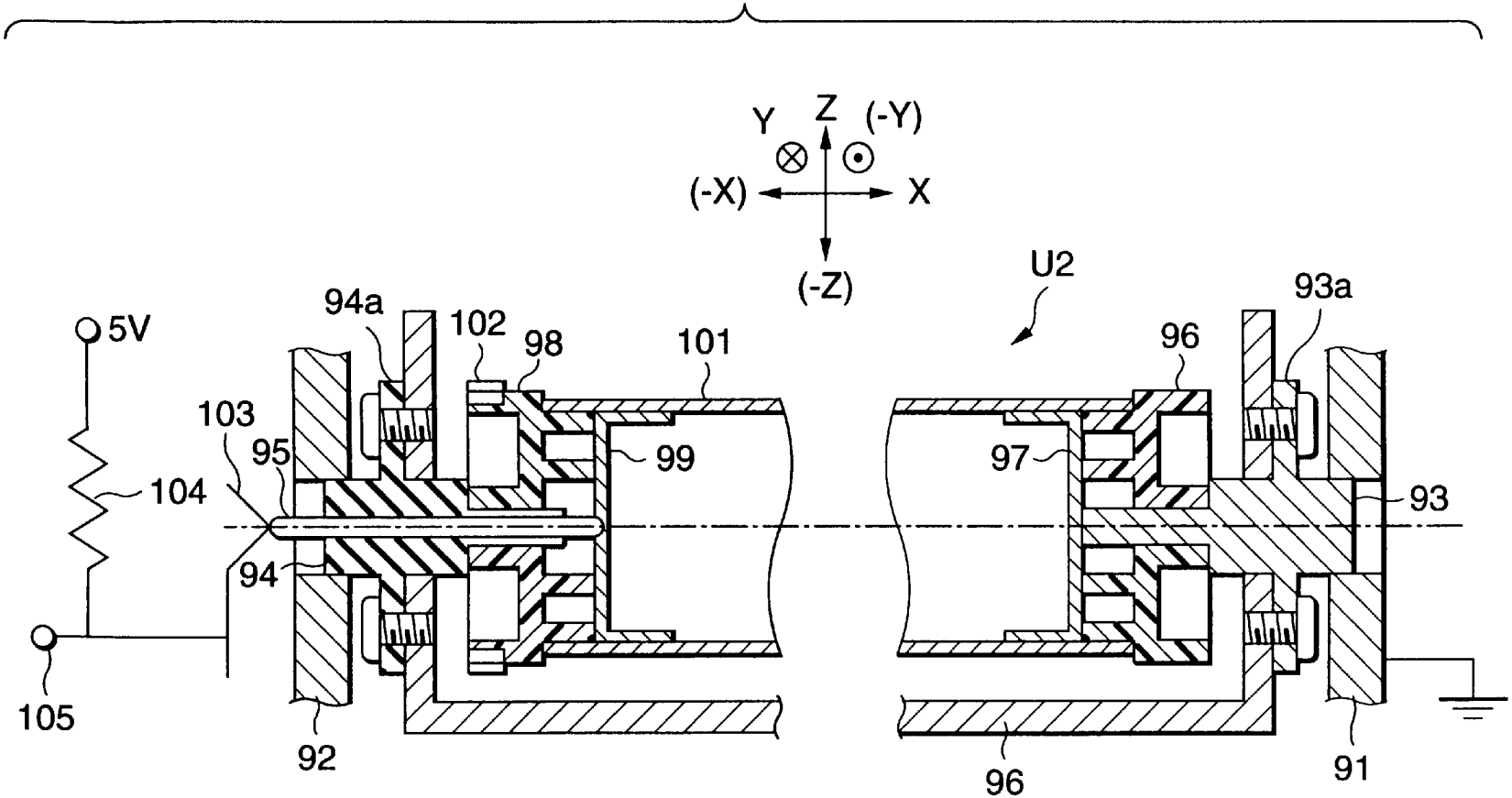
FIG. 16 is an illustration of a seventh embodiment of an image formation system also serving as an MICR printer of the invention; it is an illustration of a configuration for automatically sensing whether a process cartridge mounted in cartridge mount space V is a normal cartridge or an MICR cartridge.

FIG. 16 is an illustration of a seventh embodiment of an image formation system also serving as an MICR printer of the invention; it is an illustration of a configuration for automatically sensing whether a process cartridge mounted in cartridge mount space V is a normal cartridge or an MICR cartridge.

In FIG. 16, an MICR cartridge U2 has metal frames 91 and 92 at front and rear ends. An SUS metal shaft 93 is fixedly supported on the frame 91 and an insulative plastic shaft 94 is fixedly supported on the frame 92. A conductive shaft (detected member for cartridge discrimination) 95 is supported inside the plastic shaft 94.

A plastic housing 96 is fixed to a flange 93*a* of the metal shaft 93 and a flange 94*a* of the plastic shaft 94.

A plastic flange 96 is supported rotatably on the metal shaft 93. A phosphor bronze drum 97 is fixedly secured to the flange 96. A plastic flange 98 is supported rotatably on the plastic shaft 94. A phosphor bronze drum 99 is fixedly secured to the flange 98.

An aluminum cylinder 101 is supported by both the flanges 96 and 98 and both the drums 97 and 99. A photosensitive layer is formed on the surface of the aluminum cylinder 101.

A gear 102 is attached to the outer peripheral surface of the flange 98. The rotation force of a gear (not shown) supported on the frame 92 is transferred to the gear 102. When an MICR cartridge U2 is mounted in the image formation system main unit, the gear (not shown) meshes with a gear supported in the image formation system main unit and rotation force is transferred.

A rotatable image support is made up of the members 96–102.

The conductive shaft 95 supported in the plastic shaft 94 is grounded via the conductive phosphor bronze drum 99, the aluminum cylinder 101, the phosphor bronze drum 97, the metal shaft 93, and the metal frame 91.

The image formation system main unit is provided with a conductive plate (contact terminal) 103 at a position where the outer end of the conductive shaft 95 comes in contact with when an MICR cartridge U2 is mounted in the cartridge mount space V, and a voltage of +5 V is applied to the conductive plate 103 via a resistor 104. Therefore, when no MICR cartridge is mounted in the cartridge mount space V, voltage of 5 V occurs at an output terminal 105 connected to the conductive plate 103; when an MICR cartridge is mounted, 0 V occurs at the output terminal.

If a normal cartridge, which is not provided with the conductive shaft 95, is mounted in the cartridge mount space V, voltage of 5 V also occurs at the output terminal 105.

Therefore, whether the process cartridge U2 mounted in the cartridge mount space V of the image formation system main unit is a normal cartridge or an MICR cartridge can be determined by detecting the voltage at the output terminal 105.

Modified Examples

Although the invention has been described in its preferred embodiment with a certain degree of particularity, it is understood that the present disclosure of the preferred embodiment has been changed in the details of construction and the combination and arrangement of parts may be resorted to without departing from the spirit and the scope of the invention. Modifications of the invention are as follows:

Fuser temperature control when the process cartridge U2 is an MICR cartridge can be performed so as to hold the target temperature constant without raising the temperature for consecutive printing of 10 or more sheets of paper and 20 or more sheets of paper.

A transfer corotron can be adopted as the transfer device instead of the transfer roll.

The image formation system of the invention can produce the following effect:

there can be provided an image formation system that can be used as an MICR printer by replacing a process cartridge in the image formation system comprising an image formation system main unit and a process cartridge mounted detachably in the image formation system main unit.

What is claimed is:

1. An image formation system also serving as an MICR (magnetic ink character recognition) printer comprising:

an image support formed on a surface with an electrostatic latent image;

a process cartridge, which is detachably mounted in a cartridge mount section, having a developing machine having a developing roll placed adjoining said image support and transporting a developer to a developing area adjoining said image support for developing a toner image on the electrostatic latent image on said image support;

an optical writer for forming an electrostatic latent image on the surface of said image support by a light beam of a predetermined light quantity;

a transfer device for transferring a toner image formed on the surface of said image support to a transfer medium;

a fuser for fixing the toner image on the transfer medium at a predetermined fixing temperature; and a parameter change system having a parameter storage means storing image formation process parameters used when said process cartridge mounted in said cartridge mount section is a normal cartridge and when said process cartridge is an MICR cartridge for forming a ferromagnetic toner image that can be magnetically read, said parameter change system setting the image formation process parameters in response to the type of process cartridge mounted in said cartridge mount section.

2. The image formation system also serving as an MICR printer of claim 1, wherein if said process cartridge is said MICR cartridge, said parameter change system changes the light quantity of the light beam of said optical writer, one of the image formation process parameters, in comparison with said normal cartridge.

3. The image formation system also serving as an MICR printer of claim 1, wherein if said process cartridge is said MICR cartridge, said parameter change system changes a fixing temperature of said fuser, one of the image formation process parameters, in comparison with said normal cartridge.

4. The image formation system also serving as an MICR printer of claim 1, further comprising:

a parameter change input key, said parameter change system for setting the image formation process parameters in response to whether or not said parameter change input key is input.

5. The image formation system also serving as an MICR printer of claim 1, further comprising:

a cartridge discrimination unit for determining whether said process cartridge mounted in said cartridge mount section is a normal cartridge or an MICR cartridge for forming a ferromagnetic toner image that can be magnetically read, said parameter change system for setting the image formation process parameters in response to the type of process cartridge determined by said cartridge discrimination unit.

6. The image formation system also serving as an MICR printer of claim 5, wherein said cartridge discrimination unit is made of an optical sensor for detecting a reflected light quantity from said mounted process cartridge.

7. The image formation system also serving as an MICR printer of claim 5, wherein said cartridge discrimination unit is made of a magnetic sensor for detecting a magnetic force from said mounted process cartridge.

8. The image formation system also serving as an MICR printer of claim 5, wherein said cartridge discrimination unit has a cartridge contact terminal coming in contact with either said mounted MICR cartridge or normal cartridge for outputting a different electric signal when said cartridge contact terminal comes in contact with said either cartridge from an electric signal when said cartridge contact terminal does not come in contact with said either cartridge.

9. The image formation system also serving as an MICR printer of claim 5, further comprising:

a control panel having a cartridge discrimination input key, said cartridge discrimination unit being made of means for determining whether or not said cartridge discrimination input key is input.

10. An image formation system also serving as an MICR (magnetic ink character recognition) printer comprising:

an image support formed on a surface with an electrostatic latent image;

a process cartridge, which is detachably mounted in a cartridge mount section, having a developing machine having a developing roll placed adjoining said image support and transporting a developer to a developing area adjoining said image support for developing a toner image on the electrostatic latent image on said image support;

an optical writer for forming an electrostatic latent image on the surface of said image support by a light beam of a predetermined light quantity;

a transfer device for transferring a toner image formed on the surface of said image support to a transfer medium;

a fuser for fixing the toner image on the transfer medium at a predetermined fixing temperature; and a parameter change system having a parameter storage means for storing image formation process parameters used when said process cartridge mounted in said cartridge mount section is a normal cartridge and when said process cartridge is an MICR cartridge for forming a ferromagnetic toner image that can be magnetically read, said parameter change system for setting the image formation process parameters in response to the type of process cartridge mounted in said cartridge mount section;

wherein said normal cartridge has a developing roll formed with a molybdenum oxide film on a surface of an aluminum tube, or said MICR cartridge has a developing roll formed with an alumite film on a surface of an aluminum tube.

11. An MICR (magnetic ink character recognition) printer process cartridge, said MICR printer process cartridge comprising:

a developing machine having a developing roll placed adjoining an image support and transporting a developer to a developing area adjoining said image support for developing a toner image on an electrostatic latent image on said image support; and a detected member for cartridge discrimination indicating that said process cartridge mounted in a cartridge mount section is said MICR cartridge for forming a ferromagnetic toner image that can be magnetically read;

wherein said printer process cartridge is mounted detachably in said cartridge mount section of an image formation system main unit of an image formation system also serving as an MICR printer having a cartridge discrimination unit and an image formation parameter storage means storing information directed to image formation using an MICR cartridge and using a standard cartridge.

12. The MICR printer process cartridge of claim 11, wherein said detected member for cartridge discrimination is made of a magnet.

13. The MICR printer process cartridge of claim 11, wherein said detected member for cartridge discrimination is made of a conductive member coming in contact with a component of said cartridge discrimination unit of said image formation system main unit for changing a detected potential of said cartridge discrimination unit.

* * * * *